US009193189B2

(12) United States Patent
Suzuki

(10) Patent No.: US 9,193,189 B2
(45) Date of Patent: Nov. 24, 2015

(54) CONVEYANCE DEVICE

(71) Applicant: Riso Kagaku Corporation, Tokyo (JP)

(72) Inventor: Masao Suzuki, Tsukuba (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/521,567

(22) Filed: Oct. 23, 2014

(65) Prior Publication Data

US 2015/0116411 A1 Apr. 30, 2015

(30) Foreign Application Priority Data

Oct. 30, 2013 (JP) ..... 2013-225030

(51) Int. Cl.

| | |
|---|---|
| ***B41J 29/38*** | (2006.01) |
| ***B41J 2/01*** | (2006.01) |
| ***B41J 13/00*** | (2006.01) |
| ***B41J 11/00*** | (2006.01) |

(52) U.S. Cl.

CPC ..... *B41J 13/0009* (2013.01); *B41J 11/0045* (2013.01)

(58) Field of Classification Search

USPC ..... 347/16, 101

See application file for complete search history.

(56) References Cited

U.S. PATENT DOCUMENTS

| | | | | |
|---|---|---|---|---|
| 2006/0082617 | A1* | 4/2006 | Nagashima | 347/68 |
| 2012/0062679 | A1* | 3/2012 | Yokota | 347/104 |
| 2013/0216291 | A1* | 8/2013 | Fukusaka et al. | 400/583 |

FOREIGN PATENT DOCUMENTS

JP 2012-218349 A 11/2012

* cited by examiner

*Primary Examiner* — Jason Uhlenhake

(74) *Attorney, Agent, or Firm* — Studebaker & Brackett PC

(57) ABSTRACT

A conveyance device includes: a conveyance unit that conveys a printing paper sheet in a given conveyance direction; and a pressing unit that presses the printing paper sheet with ultrasound emitted from a plurality of ultrasound emitter elements which are arranged in a direction perpendicular to the conveyance direction and emit ultrasound of an identical frequency and an identical phase.

15 Claims, 22 Drawing Sheets

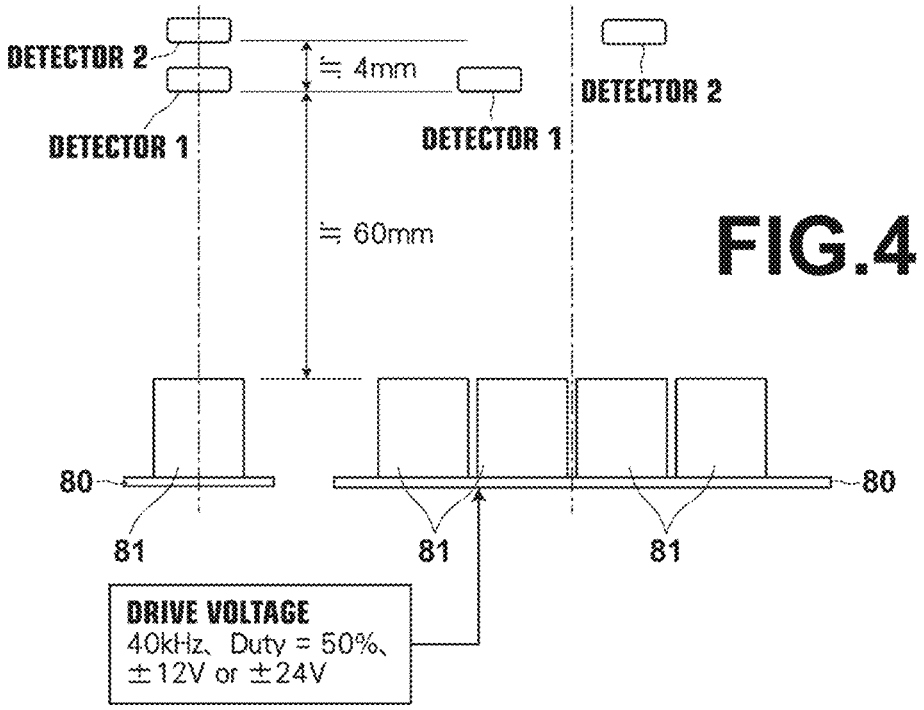
FIG.4
FIG.5
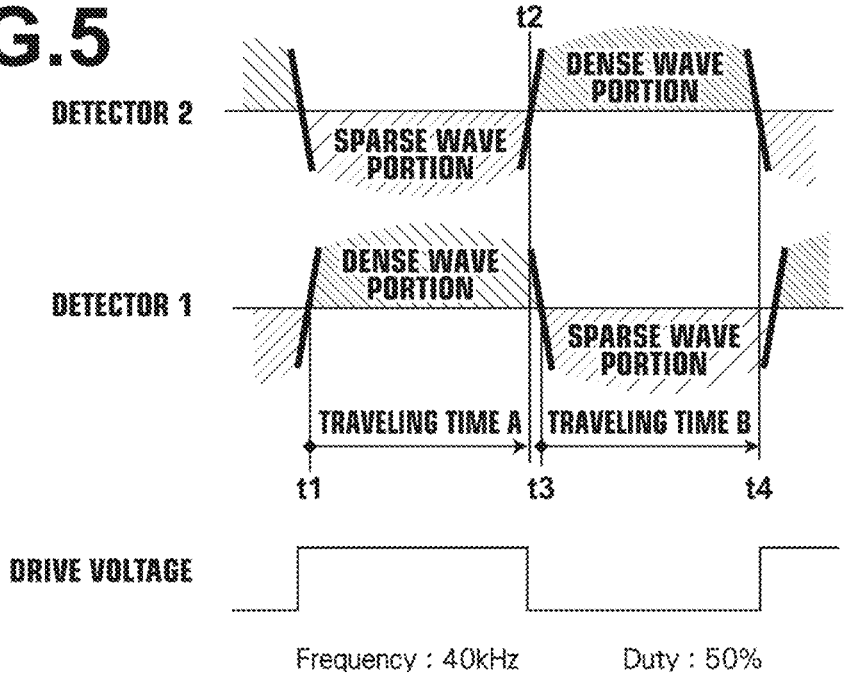

| INFORMATION ABOUT PRINTING PAPER | REGULATED VOLTAGE |
|---|---|
| Pa | V1 |
| Pb | V2 |
| Pc | V3 |
| Pd | V4 |

CONVEYANCE DEVICE

CROSS-REFERENCE TO RELATED APPLICATIONS

The present application claims priority under 35 U.S.C. §119 to Japanese Patent Application No. 2013-225030, filed on Oct. 30, 2013. The above application is hereby expressly incorporated by reference, in its entirety, into the present application.

BACKGROUND OF THE INVENTION

1. Field of the Invention

The present invention relates to a conveyance device that conveys a medium to be conveyed with pressing the medium to be conveyed.

2. Description of the Related Art

Conventionally, an inkjet printer system wherein a printing paper sheet is conveyed with being nipped between a conveying belt and nip rollers, and ink is ejected onto the printing paper sheet being conveyed to achieve printing is proposed (see, for example, Japanese Unexamined Patent Publication No. 2012-218349).

In this type of inkjet printer system, a plurality of nip rollers are arranged on the conveying belt along the conveyance direction, and the printing paper sheet is sequentially conveyed from the most upstream nip roller to the most downstream nip roller.

SUMMARY OF THE INVENTION

However, in the case where printing is performed on a printing paper sheet which is conveyed with being nipped between the conveying belt and the nip rollers, as described above, the printed surface is brought into contact with the nip rollers immediately after the ink ejection when the ink has not yet dried, and the ink adheres to the nip rollers. When the nip rollers further rotate in this state, the ink adhering to the nip rollers is retransferred to the printing paper sheet and forms a ghost image, resulting in significant degradation of the image.

This problem can be solved, for example, by using a quick-drying ink so that the ink dries in no time. However, in the case where such an ink is used, the ink may harden in the ink channel of the ink head, or the like, and may cause ink clogging.

In view of the above-described circumstances, the present invention is directed to providing a conveyance device that can convey a medium to be conveyed, such as a printing paper sheet, with pressing the medium without causing the above-described ink retransfer.

An aspect of the conveyance device of the invention comprises: a conveyance unit that conveys a medium to be conveyed in a given conveyance direction; and a pressing unit that presses the medium to be conveyed with ultrasound emitted from a plurality of ultrasound emitter elements, the ultrasound emitter elements being arranged in a direction perpendicular to the conveyance direction and emitting ultrasound of an identical frequency and an identical phase.

The "identical frequency" and the "identical phase" as used herein do not necessarily mean a completely identical frequency and a completely identical phase, and may include, for example, errors due to accuracy of the drive signal for driving the ultrasound emitter elements, errors due to manufacturing variation of the ultrasound emitter elements, etc.

In the above-described conveyance device of the invention, the conveyance unit may be disposed to face the pressing unit such that the medium to be conveyed is conveyed between the conveyance unit and the pressing unit.

The pressing unit may comprise a plurality of pressing units arranged along the conveyance direction, and the pressing units may emit the ultrasound in turn from the most upstream-side pressing unit to the most downstream-side pressing unit in the conveyance direction.

A conveying roller may be used as the conveyance unit, and a plurality of sets of the pressing unit and the conveying roller may be disposed along the conveyance direction.

A conveyance position detection unit that detects a conveyance position of the medium to be conveyed may be provided, wherein each pressing unit may start emission of the ultrasound at or after a point of time when the leading edge of the medium to be conveyed reaching the pressing unit is detected by the conveyance position detection unit.

Alternatively, a conveyance position detection unit that detects a conveyance position of the medium to be conveyed may be provided, wherein each pressing unit may start emission of the ultrasound at a point of time when the leading edge of the medium to be conveyed reaching a position just in front of the pressing unit is detected by the conveyance position detection unit.

Each pressing unit may stop emission of the ultrasound at a point of time when the trailing edge of the medium to be conveyed being just about to pass through the pressing unit is detected by the conveyance position detection unit.

A driving unit that supplies a drive voltage having a drive frequency corresponding to the frequency and the phase of the ultrasound to each of the ultrasound emitter elements may be provided, wherein the driving unit may change the drive voltage depending on information about the medium to be conveyed.

The pressing unit may emit the ultrasound from the ultrasound emitter elements in order from the ultrasound emitter element disposed at the center in the direction perpendicular to the conveyance direction to the ultrasound emitter elements disposed at opposite ends in the direction perpendicular to the conveyance direction.

The ultrasound emitter element may comprise a plate-like deformable plate portion that deforms into a convex shape and a concave shape in response to application of drive voltages, and a vibration plate comprising a parabola shape, the vibration plate being connected such that the apex of the parabola shape is in contact with the deformable plate portion, wherein the vibration plate has a structure that deforms toward the inner side of the parabola shape when the deformable plate portion deforms into the concave shape to move toward the apex of the parabola shape, and the vibration plate emits non-linear ultrasound wherein a pressure in a negative direction that is generated when the vibration plate moves toward the apex of the parabola shape is smaller than a pressure in a positive direction that is generated when the vibration plate moves toward the opening of the parabola shape.

The vibration plate may comprise a frame including a plurality of radially extending linear portions, and a petal-shaped film provided on the inner side of the parabola shape of the frame, the petal-shaped film including slits formed at positions corresponding to the linear portions, wherein, when the vibration plate moves toward the apex, peripheral areas of the petal-shaped film are separated from the frame to let air flow in.

Alternatively, the vibration plate may comprise a plurality of elastic ribs radially arranged against a resin film, wherein, when the vibration plate moves toward the apex of the parabola shape, the ribs deform toward the inner side of the parabola shape.

According to the conveyance device of the invention, the plurality of ultrasound emitter elements emit ultrasound of an identical frequency and an identical phase to press the medium to be conveyed with the ultrasound. In a case where, for example, the ultrasound is used in place of the nip rollers to press a printing paper sheet in the above-described inkjet printer system, the printing paper sheet can be pressed in a non-contact manner, thereby preventing the retransfer of the ink.

BRIEF DESCRIPTION OF THE DRAWINGS

FIG. 4 is a diagram illustrating a measurement system for measuring non-linear characteristics of ultrasound, FIG. 5 is a diagram illustrating detected waveforms of ultrasound detected by a detector 1 and a detector 2.

DESCRIPTION OF THE PREFERRED EMBODIMENTS

Figure 1:
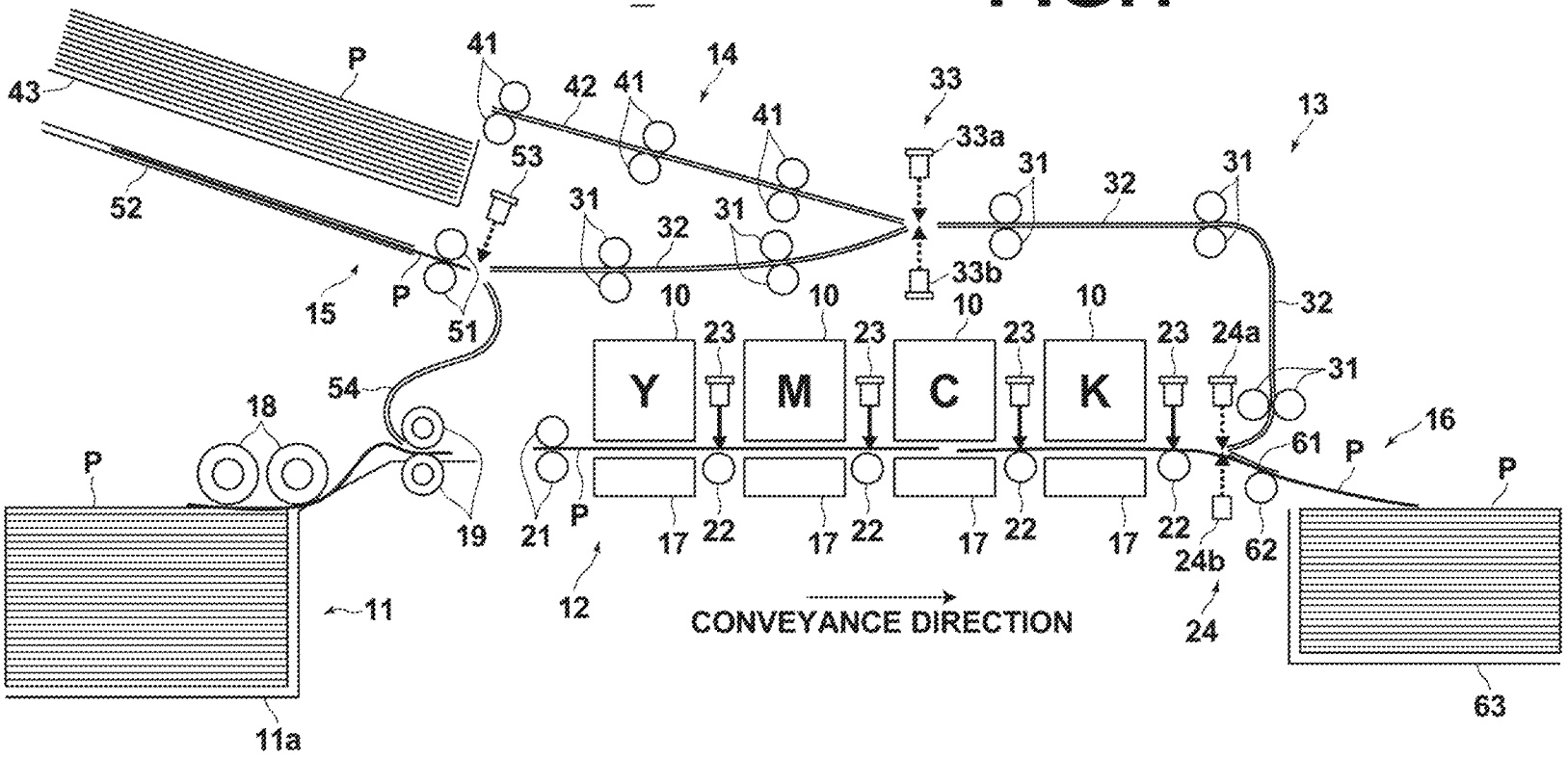
FIG. 1 is a diagram illustrating the entire schematic configuration of a printing system which employs one embodiment of a conveyance device of the invention.

Hereinafter, a printing system employing one embodiment of a conveyance device of the present invention will be described in detail with reference to the drawings. The printing system of this embodiment is characterized by the configuration of the conveyance device for conveying printing paper sheets. First, the configuration of the entire printing system is described. FIG. 1 is a diagram illustrating the entire schematic configuration of a printing system 1 of this embodiment.

The printing system 1 performs printing on a printing paper sheet P based on print job data that is outputted from a computer or read image data that is photoelectrically read at an original reading unit.

The printing system 1 includes an ink head unit 10, a paper feeding section 11, a paper conveyance section 12, a top side conveyance section 13, a first paper output section 14, an inverting section 15, a second paper output section 16, and a cleaning unit 17.

The ink head unit 10 ejects ink onto the printing paper sheet P based on the print job data or the read image data to achieve printing. The ink head unit 10 of this embodiment includes line-type ink heads extending in a direction perpendicular to the conveyance direction of the printing paper sheet P, and includes a plurality of line-type ink heads for ejecting inks of different colors including black K, cyan C, magenta M and yellow Y. The ink heads of these colors are arranged along the conveyance direction of the printing paper sheet P.

The cleaning unit 17 is provided for the ink head of each color, and is disposed between conveying rollers 22, which will be described later. The cleaning unit 17 receives ink that is ejected from the ink head during cleaning, and wipes the ink ejection face of the ink head to remove the ink adhering to the ink ejection face.

The paper feeding section 11 feeds each printing paper sheet P to the ink head unit 10. The paper feeding section 11 includes: a paper feeding tray 11*a* on which printing paper sheets P are placed; pick-up rollers 18 that pick up each printing paper sheet P placed on the paper feeding tray 11*a*; registration rollers 19 that once stop the leading edge of the printing paper sheet P picked up by the pick-up rollers 18 to perform skew correction and then convey the printing paper sheet P toward the paper conveyance section 12 at predetermined timing; and a plurality of motors (not shown) that drive the individual rollers.

The paper conveyance section 12 includes: nip rollers 21 formed by a pair of rollers that receive the printing paper sheet P conveyed from the registration rollers 19 and convey the printing paper sheet P to the ink head unit 10; conveying rollers 22 that convey the printing paper sheet P conveyed by the nip rollers 21 from the upstream side to the downstream side of the ink head unit 10; a pressing unit 23 that is provided for each conveying roller 22 to face the conveying roller such that the printing paper sheet P is conveyed therebetween, and presses the printing paper sheet P against the conveying roller 22 by emitting ultrasound toward the printing paper sheet P; a first conveyance path switching section 24 that switches the conveyance path, to which the printing paper sheet P conveyed by the conveying rollers 22 is directed, between the conveyance path of the top side conveyance section 13 and the conveyance path of the second paper output section 16; and a plurality of motors (not shown) that drive the individual rollers.

The conveying rollers 22 and the pressing units 23 are provided such that a plurality of sets of the conveying roller 22 and the pressing unit 23 are disposed along the conveyance direction of the printing paper sheet P. Each set of the conveying roller and the pressing unit 23 is disposed between the ink heads of the individual colors. The pressing units 23 and the first conveyance path switching section 24 will be described in detail later.

The top side conveyance section 13 conveys the printing paper sheet P conveyed by the paper conveyance section 12 such that the printing paper sheet P makes a U-turn from the rightward direction to the leftward direction on FIG. 1. The top side conveyance section 13 includes a plurality of top side conveying rollers 31 formed by pairs of rollers; a top side paper guide 32; a second conveyance path switching section 33; and a plurality of motors (not shown) that drive the individual rollers.

The second conveyance path switching section 33 is disposed in the middle of the conveyance path of the top side conveyance section 13. The second conveyance path switching section 33 emits ultrasound toward the leading edge of the printing paper sheet P conveyed thereto to press the leading edge of the printing paper sheet P, thereby achieving the switching of the conveyance path, to which the leading edge of the printing paper sheet P is directed, between the conveyance path toward the first paper output section 14 and the conveyance path toward the inverting section 15. The second conveyance path switching section 33 will be described in detail later.

The first paper output section 14 outputs and stacks each printed printing paper sheet P. The first paper output section 14 includes: a first paper output section guide 42 that guides the printing paper sheet P conveyed by the top side conveyance section 13 with the leading edge of the printing paper sheet P being pressed upward by the second conveyance path switching section 33; first paper output rollers 41 formed by pairs of rollers that convey the printing paper sheet P guided by the first paper output section guide 42; a first paper output tray 43 on which each printing paper sheet P conveyed by the first paper output rollers 41 is discharged and stacked; and a plurality of motors (not shown) that drive the individual rollers.

When duplex printing is performed, the inverting section 15 inverts each one side printed printing paper sheet P and conveys the one side printed printing paper sheet P to the registration rollers 19. The inverting section 15 includes: inverting rollers 51 formed by a pair of rollers that receive the one side printed printing paper sheet P conveyed by the top side conveyance section 13, convey the printing paper sheet P to a switchback section 52, and then convey the printing paper sheet P in the switchback section 52 to the registration rollers 19; the switchback section 52 that temporarily receives the printing paper sheet P conveyed by the inverting rollers 51; a third conveyance path switching section 53 that emits, when the leading edge of the printing paper sheet P temporarily received by the switchback section 52 is discharged from the switchback section 52, ultrasound toward the leading edge to press the leading edge to thereby guide the leading edge of the printing paper sheet P to the conveyance path toward registration rollers 19; an inverting paper guide 54 that guides the printing paper sheet P with the leading edge being pressed by the third conveyance path switching section 53 to the registration rollers 19; and a motor (not shown) that drives the inverting rollers 51.

It should be noted that, when the printing paper sheet P conveyed from the top side conveyance section 13 is received by the inverting rollers 51, no ultrasound is emitted from the third conveyance path switching section 53. The top side paper guide 32 of the top side conveyance section 13 and the inverting rollers 51 are disposed such that the leading edge of the printing paper sheet P discharged from the top side conveyance section 13 is guided to the inverting rollers 51 when no ultrasound is emitted. The third conveyance path switching section 53 will be described in detail later.

The second paper output section 16 outputs and stacks each printed printing paper sheet P conveyed by the paper conveyance section 12. The second paper output section 16 includes: a second paper output section guide 61 that guides the printing paper sheet P with the leading edge being pressed downward with the ultrasound emitted from the first conveyance path switching section 24; a second paper output roller 62 that conveys the printing paper sheet P guided by the second paper output section guide 61; a second paper output tray 63 on which each printing paper sheet P conveyed by the second paper output roller 62 is discharged and stacked; and a motor (not shown) that drives the second paper output roller 62.

The above description is the explanation of the entire printing system 1.

Next, the configuration of the pressing units 23 of the paper conveyance section 12 and the control system thereof are described with reference to FIG. 2.

Each pressing unit 23 includes a substrate 80, and a plurality of ultrasound emitter elements 81 that are arranged on the substrate 80 along the direction perpendicular to the conveyance direction of the printing paper sheet P. The ultrasound emitter elements 81 are driven to emit ultrasound of an identical frequency and an identical phase. Each ultrasound emitter element 81 emits the ultrasound toward the printing paper sheet P that passes through below the pressing unit 23. The emitted ultrasound presses the printing paper sheet P against the conveying roller 22, so that the printing paper sheet P is in contact with the conveying roller 22 and is conveyed by rotation of the conveying roller 22.

As the ultrasound emitter element 81, an element usable in an ultrasound sensor or a parametric speaker, for example, may be used. A specific example of the element usable as the ultrasound emitter element is MA40S4S (available from Murata Manufacturing Co., Ltd.) The MA40S4S is an ultrasound sensor; however, it is used to press the printing paper sheet P in this embodiment. Specifications of the MA40S4S are: a central frequency of 40 kHz, a sound pressure of 120 dB, and a directivity of 80°.

Each pressing unit 23 is controlled by the paper press control unit 25. The paper press control unit 25 includes pressing unit driving sections 26 that control driving of the individual pressing units 23. The pressing unit driving section 26 supplies a drive voltage to the ultrasound emitter elements 81 of the pressing unit 23. The pressing unit driving section 26 is provided for each pressing unit 23, and is configured to be capable of independently controlling driving of the corresponding pressing unit 23.

Figure 3:
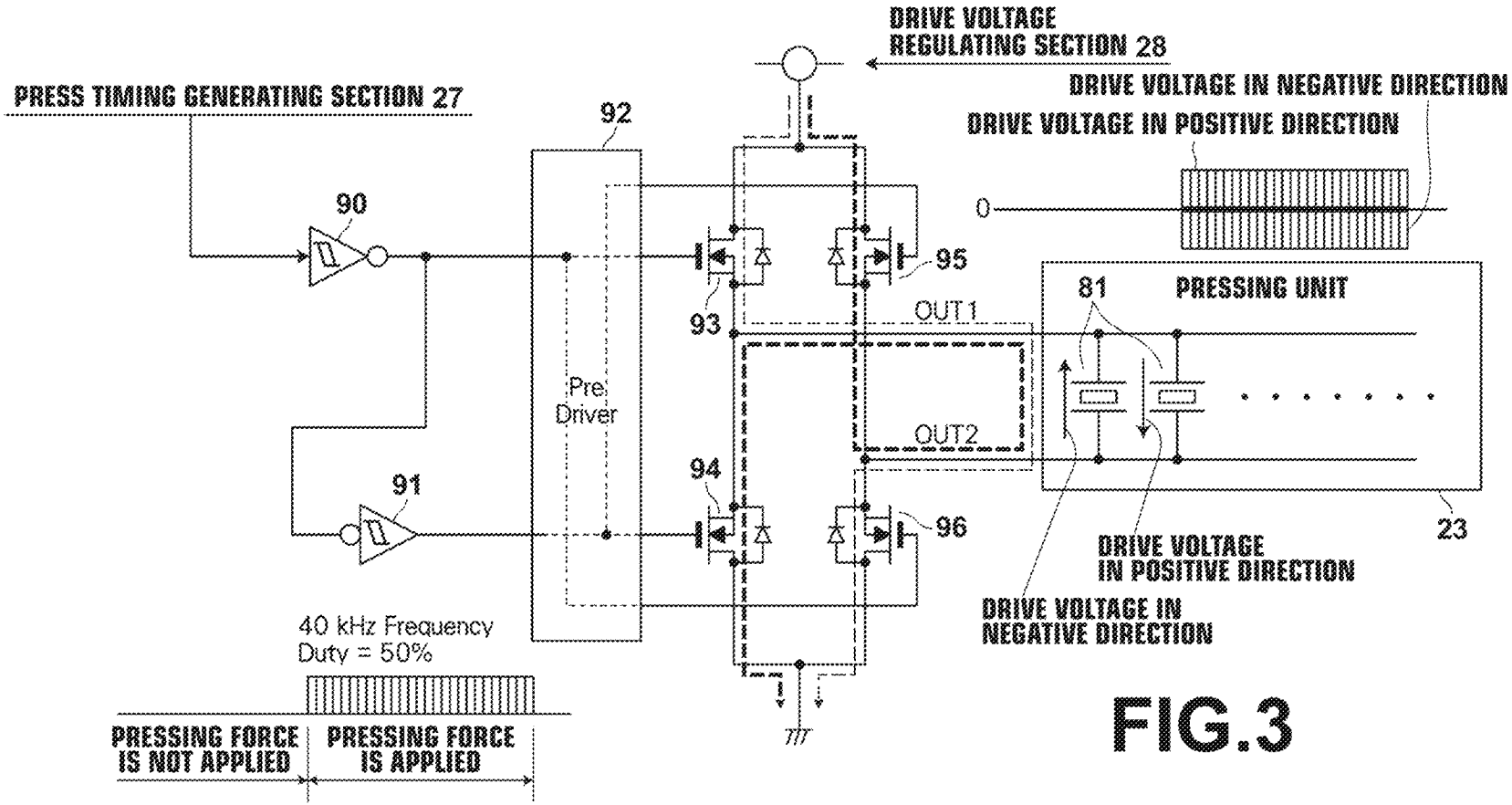
FIG. 3 is a diagram illustrating the detailed circuit configuration of a pressing unit driving section.

FIG. 3 is a circuit diagram illustrating the configuration of the pressing unit driving section 26. As shown in FIG. 3, the pressing unit driving section 26 includes two inverter circuits 90 and 91, a pre-driver circuit 92, and four switching elements 93 to 96.

A drive signal outputted from a press timing generating section 27 (see FIG. 2) is inputted to the inverter circuit 90, and an output signal from the inverter circuit 90 is inputted to the inverter circuit 91. The press timing generating section 27 generates and outputs a rectangular waveform signal having a frequency of 40 kHz and a duty cycle of 50%, and this waveform signal is inputted to the inverter circuit 90.

An output signal from the inverter circuits 90 and 91 is inputted to the pre-driver circuit 92, and an output signal from the pre-driver circuit 92 is inputted to the four switching elements 93 to 96. Among the four switching elements 93 to 96, the switching elements 93 and 96 are turned on at the same time, or the switching elements 95 and 94 are turned on at the same time, depending on the output signal from the pre-driver circuit 92.

To the switching elements 93 to 96, a direct-current regulated voltage outputted from a drive voltage regulating section 28 is supplied. When the operation to turn on the switching elements 93 and 96 and the operation to turn on the switching elements 95 and 94 are alternately performed, a drive voltage in the positive direction and a drive voltage in the negative direction are alternately applied to the ultrasound emitter elements 81. In response to the application of the drive voltages in the positive and negative directions, the ultrasound emitter elements 81 emit ultrasound of 40 kHz. The ultrasound emitter elements 81 of the pressing unit 23 are connected in series such that terminals of the same polarity of the ultrasound emitter elements are connected in parallel. Thus, the ultrasound emitter elements 81 emit ultrasound of an identical frequency and an identical phase.

Now, the principle of how the printing paper sheet P is pressed with the ultrasound emitted from the ultrasound emitter elements 81 is explained.

Each ultrasound emitter element 81 includes an ultrasonic vibration source, and ultrasound is emitted due to vibration of the ultrasonic vibration source. The ultrasound emitted from the ultrasound emitter elements 81 propagates in the air and reaches the printing paper sheet P. At this time, the ultrasound propagating in the air has non-linear characteristics. Specifically, when the ultrasound propagates in the air, sparse wave portions and dense wave portions are alternately formed. The cause of this phenomenon is believed to be that it takes a longer time for air molecules to be decompressed than to be compressed by the vibration of the ultrasonic vibration source. This is not limited to ultrasound, and vibration propagating in the air is attributed to propagation of denseness and sparseness of groups of air molecules. Due to viscosity of the air, the non-linear characteristics tend to be more notable when the vibration frequency is higher, and it is believed that the non-linear characteristics is particularly notable in the case of ultrasound.

Then, it is believed that the alternately formed sparse wave portions and dense wave portions due to the non-linear characteristics of ultrasound generate a pressing force. Now, results of measurement of the non-linear characteristics of ultrasound are described. FIG. 4 shows a measurement system for measuring the non-linear characteristics of ultrasound. It should be noted that the diagram shown on the left in FIG. 4 represents a side view of the measurement system shown on the right in FIG. 4.

As shown in FIG. 4, in this example, four ultrasound emitter elements 81 (MA40S4S, available from Murata Manufacturing Co., Ltd.), which were connected in series such that terminals of the same polarity were connected in parallel, were used, and a detector 1 and a detector 2 (MA40S4R, available from Murata Manufacturing Co., Ltd.) for detecting the waveform of ultrasound emitted from the ultrasound emitter elements 81 were disposed above the ultrasound emitter elements 81. A drive voltage of ±12V or ±24V was supplied at a frequency of 40 kHz and a duty cycle of 50% to the ultrasound emitter elements 81 to cause the ultrasound emitter elements 81 to emit ultrasound of a frequency of 40 kHz (wavelength $\lambda$=8.66 mm).

The detector 1 was disposed at a position about 60 mm above the ultrasound emitting faces of the ultrasound emitter elements 81, and the detector 2 was disposed at a position about 4 mm, which is about ½ wavelength, higher than the position of the detector 1, so that ultrasound waveforms of opposite phases are detected by the detector 1 and the detector 2, respectively. FIG. 5 shows detected waveforms detected by the detector 1 and the detector 2.

Then, traveling time of the compressional wave of the ultrasound emitted from the ultrasound emitter elements 81 was measured, and propagation velocity of the compressional wave was calculated. Specifically, based on the detected waveforms, as shown in FIG. 5, detected by the detector 1 and the detector 2, a time from a point of time t1 when a dense wave portion is detected by the detector 1 to a point of time t2 when the dense wave portion is detected by the detector 2 was measured as a traveling time A of the dense wave portion, and a time from a point of time t3 when a sparse wave portion is detected by the detector 1 to a point of time t4 when the sparse wave portion is detected by the detector 2 was measured as a traveling time B of the sparse wave portion. If the propagation velocity in the air in the measurement environment is linear, the traveling time of the dense wave portion and the traveling time of the sparse wave portion shown in FIG. 5 are equal to each other.

Figure 6:
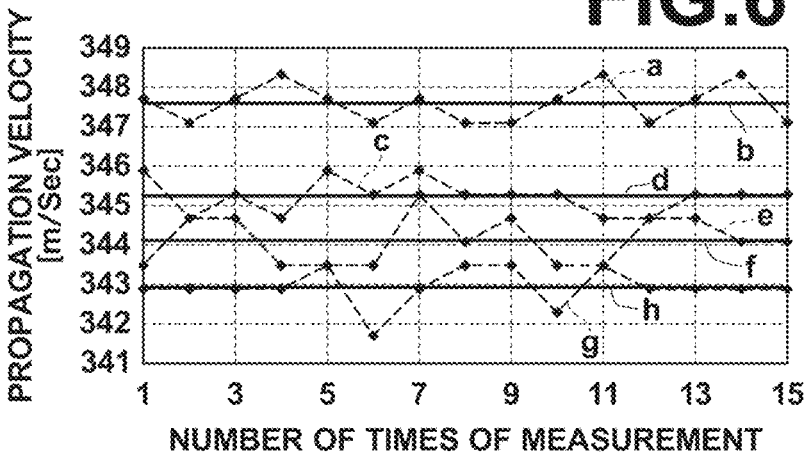
FIG. 6 is a graph showing results of measurement of propagation velocities of a dense wave portion and a sparse wave portion of ultrasound in a case where a drive voltage supplied to ultrasound emitter elements is ±24V and in a case where the drive voltage supplied to the ultrasound emitter elements is ±12V.

Then, the propagation velocity of the dense wave portion was calculated based on the distance (4 mm) between the detector 1 and the detector 2 and the traveling time A of the dense wave portion, and the propagation velocity of the sparse wave portion was calculated based on the distance (4 mm) between the detector 1 and the detector 2 and the traveling time B of the sparse wave portion. FIG. 6 show results of fifteen times of measurement of the propagation velocities of the dense wave portion and the sparse wave portion when the drive voltage was ±24V and when the drive voltage was ±12V.

Specifically, graph "a" shown in FIG. 6 represents measured propagation velocities of the dense wave portion when the drive voltage was ±24V, and graph "b" represents an average value of the propagation velocities represented by the graph a. Graph "c" represents measured propagation velocities of the sparse wave portion when the drive voltage was ±24V, and graph "d" represents an average value of the propagation velocities represented by the graph c. Graph "e" represents measured propagation velocities of the dense wave portion when the drive voltage was ±12V, and graph "f" represents an average value of the propagation velocities represented by the graph e. Graph "g" represents measured propagation velocities of the sparse wave portion when the drive voltage was ±12V, and graph "h" represents an average value of the propagation velocities represented by the graph g.

According to the graphs b and d shown in FIG. 6, the average value of the propagation velocities of the dense wave portion when the drive voltage was ±24V was 347.589 m/s, and the average value of the propagation velocities of the sparse wave portion when the drive voltage was ±24V was 345.240 m/s. Also, according to the graphs f and h shown in FIG. 6, the average value of the propagation velocities of the dense wave portion when the drive voltage was ±12V was 344.118 m/s, and the average value of the propagation velocities of the sparse wave portion when the drive voltage was ±12V was 342.922 m/s. Thus, it was found that the propagation velocities of the dense wave portion and the sparse wave portion of the ultrasound emitted from the ultrasound emitter elements 81 are different from each other and have non-linear characteristics.

Figure 7:
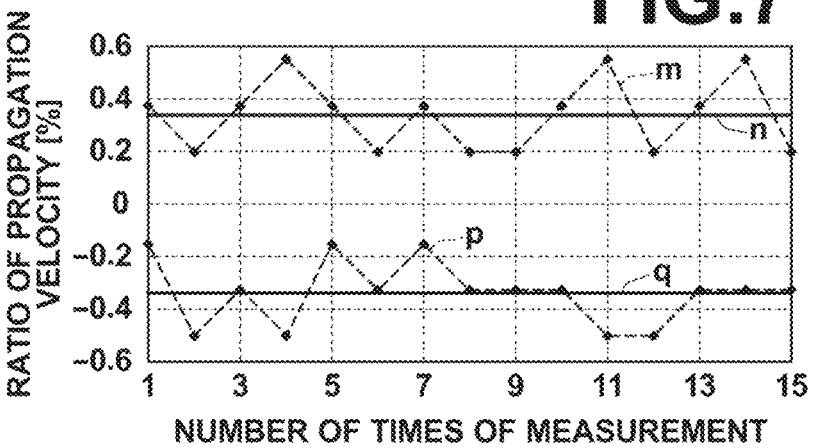
FIG. 7 is a graph showing a ratio of the propagation velocity of the dense wave portion and a ratio of the propagation velocity of the sparse wave portion relative to an average value of the propagation velocities of the dense wave portion and the sparse wave portion of ultrasound, respectively (in the case where the drive voltage supplied to the ultrasound emitter elements is ±24V), FIG. 8 a graph showing a ratio of the propagation velocity of the dense wave portion and a ratio of the propagation velocity of the sparse wave portion relative to an average value of the propagation velocities of the dense wave portion and the sparse wave portion of ultrasound, respectively (in the case where the drive voltage supplied to the ultrasound emitter elements is ±12V)
Figure 8:
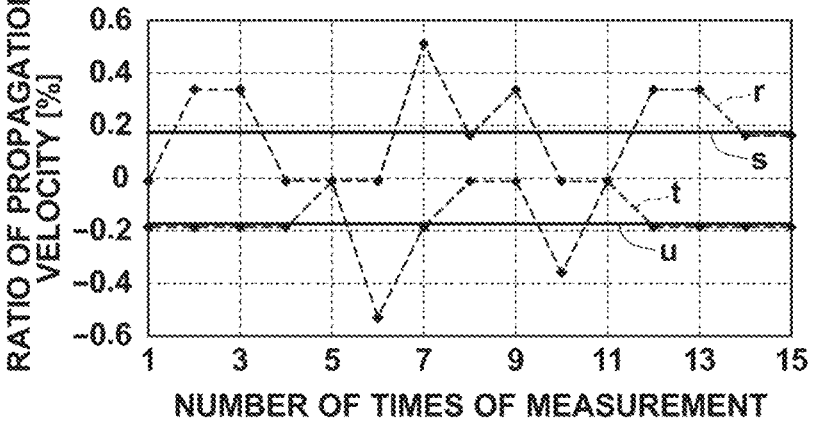

Further, FIG. 7 shows a ratio of the propagation velocity of the dense wave portion and a ratio of the propagation velocity of the sparse wave portion relative to an average value of the propagation velocities of the dense wave portion and the sparse wave portion when the drive voltage was ±24V, and FIG. 8 shows a ratio of the propagation velocity of the dense wave portion and a ratio of the propagation velocity of the sparse wave portion relative to an average value of the propagation velocities of the dense wave portion and the sparse wave portion when the drive voltage was ±12V. Specifically, graph "m" shown in FIG. 7 represents the ratio of the propagation velocity of the dense wave portion when the drive voltage was ±24V, and graph "n" represents the average value of the graph m. Graph "p" represents the ratio of the propagation velocity of the sparse wave portion when the drive voltage was ±24V, and graph "q" represents the average value of the graph p. Graph "r" shown in FIG. 8 represents the ratio of the propagation velocity of the dense wave portion when the drive voltage was ±12V, and graph "s" represents the average value of the graph r. Graph "t" represents the ratio of the propagation velocity of the sparse wave portion when the drive voltage was ±12V, and graph "u" represents the average value of the graph t.

According to the graphs n and q shown in FIG. 7, a non-linear characteristic ratio which is a difference between the ratio of the propagation velocity of the dense wave portion and the ratio of the propagation velocity of the sparse wave portion when the drive voltage was ±24V was 0.678%. Also, according to the graphs s and u shown in FIG. 8, a non-linear characteristic ratio which is a difference between the ratio of the propagation velocity of the dense wave portion and the ratio of the propagation velocity of the sparse wave portion when the drive voltage was ±12V was 0.348%. Thus, it was found that the non-linear characteristic ratio varies depending on the magnitude of the drive voltage, and the non-linear characteristic ratio is higher when the drive voltage is higher.

In the case where the drive voltage is ±24V, assuming that the speed of sound in the air is 346 m/s (at 25° C.), 346 m/s×0.678%≈2 m/s, and therefore it is theoretically estimated that a pressing force that moves the printing paper sheet P at a velocity of 2 m/s is generated when the ultrasound is emitted toward the printing paper sheet P. In the case where the drive voltage is ±12V, assuming that the speed of sound in the air is 346 m/s (at 25° C.), 346 m/s×0.348% 1 m/s, and therefore it is theoretically estimated that a pressing force that moves the printing paper sheet P at a velocity of 1 m/s is generated when the ultrasound is emitted toward the printing paper sheet P.

The above description is the explanation of the principle of how a pressing force is generated by emission of the ultrasound.

Next, control exerted when the printing paper sheet P is conveyed by the paper conveyance section 12 is described with reference to FIGS. 2, 9 and 10.

Figure 9:
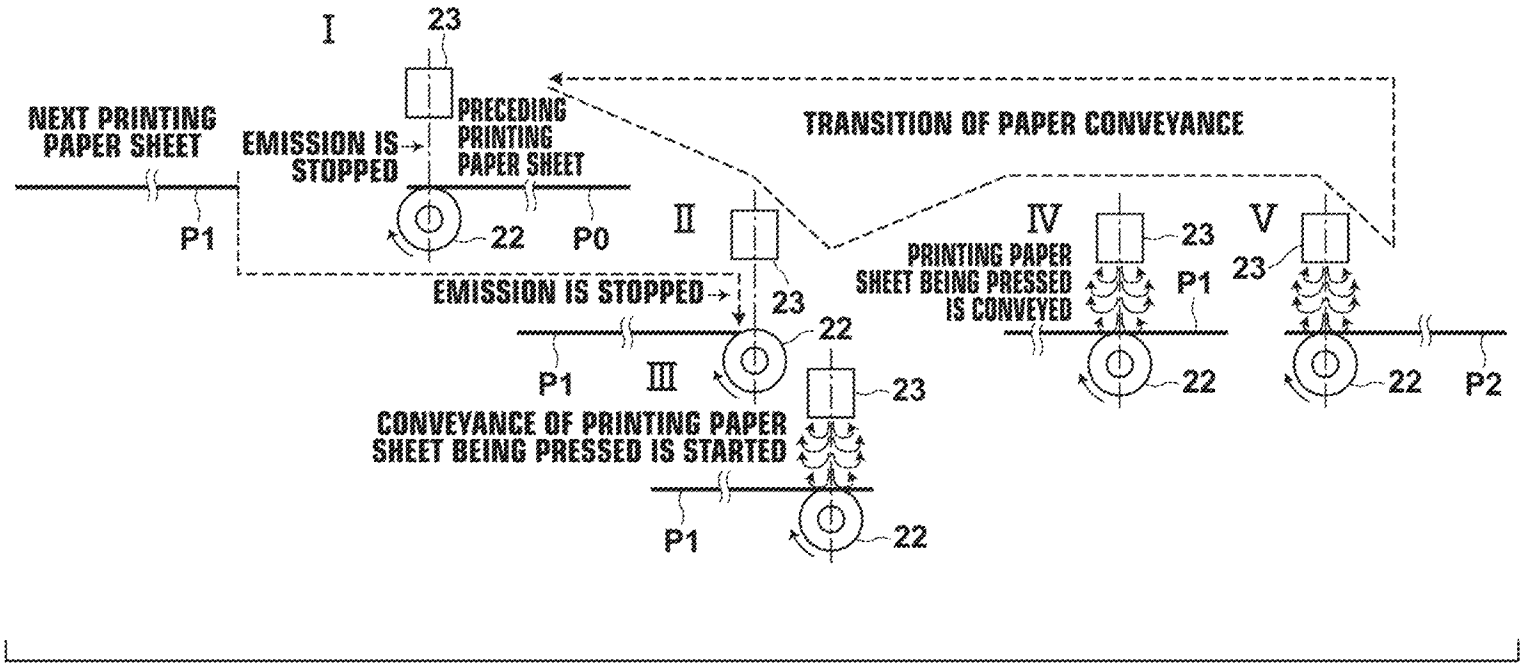
FIG. 9 is a diagram for explaining timing to start emission of ultrasound and timing to stop the emission of the ultrasound from each pressing unit in time order.

FIG. 9 (I to V) is a diagram for explaining timing to start emission of the ultrasound and timing to stop the emission of the ultrasound from each pressing unit 23 in time order. The order of the states shown at I to V in FIG. 9 corresponds to the time order.

First, as shown at I in FIG. 9, emission of the ultrasound from the pressing unit 23 facing a given conveying roller 22 is stopped immediately before the trailing edge of a preceding printing paper sheet P0 being conveyed passes through the central axis position of the conveying roller 22. The reason of stopping the emission of the ultrasound before the trailing edge of the printing paper sheet P0 passes through the conveying roller 22 as described above is that, if the emission of the ultrasound is continued until the trailing edge of the printing paper sheet P0 passes through the conveying roller 22, the trailing edge of the printing paper sheet P0 may be bent and this may exert an adverse effect on the conveyance of the printing paper sheet P0. It should be noted that the point of time immediately before the trailing edge of the printing paper sheet P0 passes through the central axis position of the conveying roller 22 can be found based on the distance between the pressing unit 23 and the printing paper sheet P0, and the propagation velocity of the ultrasound.

Then, as shown at II in FIG. 9, emission of the ultrasound is stopped until the leading edge of the next printing paper sheet P1 reaches the central axis position of the conveying roller 22 after the preceding printing paper sheet P0 being conveyed has passed through the conveying roller 22. Then, as shown at III in FIG. 9, emission of the ultrasound from the pressing unit 23 is started at or after a point of time when the leading edge of the next printing paper sheet P1 reaches the central axis position of the conveying roller 22, so that the printing paper sheet P1 is pressed against the conveying roller 22 and is conveyed by rotation of the conveying roller 22.

The reason of starting the emission of the ultrasound from the point of time when the leading edge of the printing paper sheet P1 reaches the conveying roller 22 as described above is that, if the emission of the ultrasound is started before the leading edge of the printing paper sheet P1 reaches the conveying roller 22, the leading edge of the printing paper sheet P1 may be bent and this may exert an adverse effect on the conveyance of the printing paper sheet P1.

As shown at IV in FIG. 9, the ultrasound is continuously emitted from the pressing unit 23, and the printing paper sheet P1 is conveyed by the pressing force and the rotation of the conveying roller 22, and the emission of the ultrasound from the pressing unit 23 is continued until the trailing edge of printing paper sheet P1 comes close to the central axis position of the conveying roller 22, as shown at V in FIG. 9. Then, the emission of the ultrasound from the pressing unit 23 facing the conveying roller 22 is stopped immediately before the trailing edge of printing paper sheet P1 passes through the central axis position of the conveying roller 22.

While emission of the ultrasound from a given conveying roller 22 is started at or after a point of time when the leading edge of the printing paper sheet P1 reaches the central axis position of the conveying roller 22 in this embodiment, as described above, a time taken for the ultrasound emitted from the pressing unit 23 to reach the printing paper sheet P1, for example, may be taken into account and emission of the ultrasound may be started such that the ultrasound reaches the leading edge of the printing paper sheet P1 at a point of time when the leading edge of the printing paper sheet P1 reaches the central axis position of the conveying roller 22. That is, emission of the ultrasound may be started at a point of time immediately before the leading edge of the printing paper sheet P1 reaches the central axis position of the conveying roller 22. The point of time immediately before the leading edge of the printing paper sheet P1 reaches the central axis position of the conveying roller 22 can be found based on the distance between the pressing unit 23 and the printing paper sheet P1, and the propagation velocity of the ultrasound.

Figure 2:
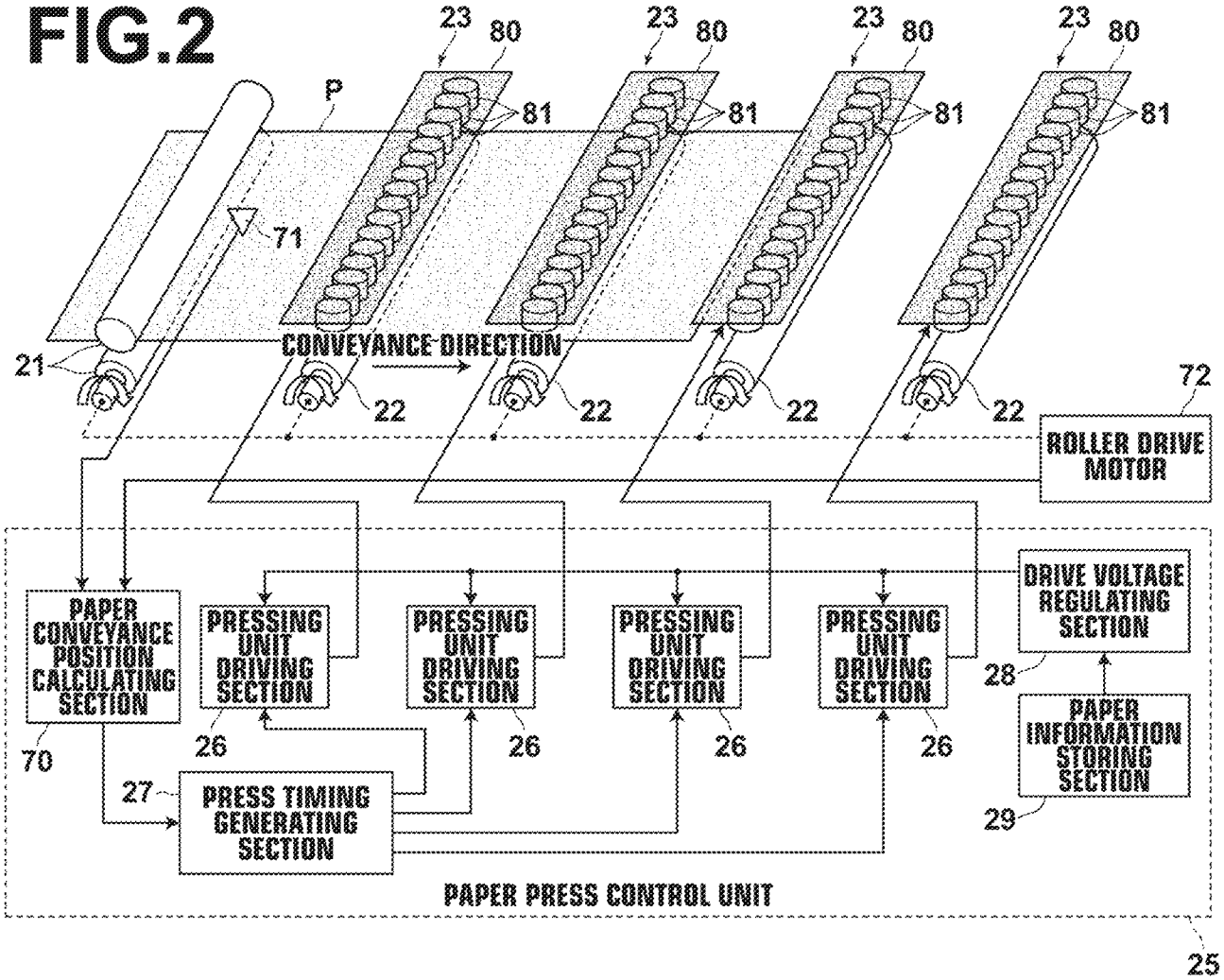
FIG. 2 is a diagram illustrating the detailed configuration of pressing units and a control system of the pressing units.

The above-described timing to start and stop emission of the ultrasound from the pressing unit 23 is controlled by the press timing generating section 27 of the paper press control unit 25 shown in FIG. 2. As described above, the press timing generating section 27 generates and outputs a rectangular waveform signal of a frequency of 40 kHz and a duty cycle of 50%. This waveform signal is inputted to each pressing unit driving section 26, and the pressing unit driving section 26 supplies the drive voltages in the positive and negative directions according to the waveform signal to the corresponding pressing unit 23, thereby controlling the timing of emission of the ultrasound.

The press timing generating section 27 generates waveform signals that start emission of the ultrasound from the pressing units 23 in order from the most upstream-side pressing unit 23 to the most downstream-side pressing unit 23 in the conveyance direction and stop the emission of the ultrasound from the pressing units 23 in order from the most upstream-side pressing unit 23 to the most downstream-side pressing unit 23 in the conveyance direction, and outputs the waveform signals to the individual pressing unit driving sections 26.

Figure 10:
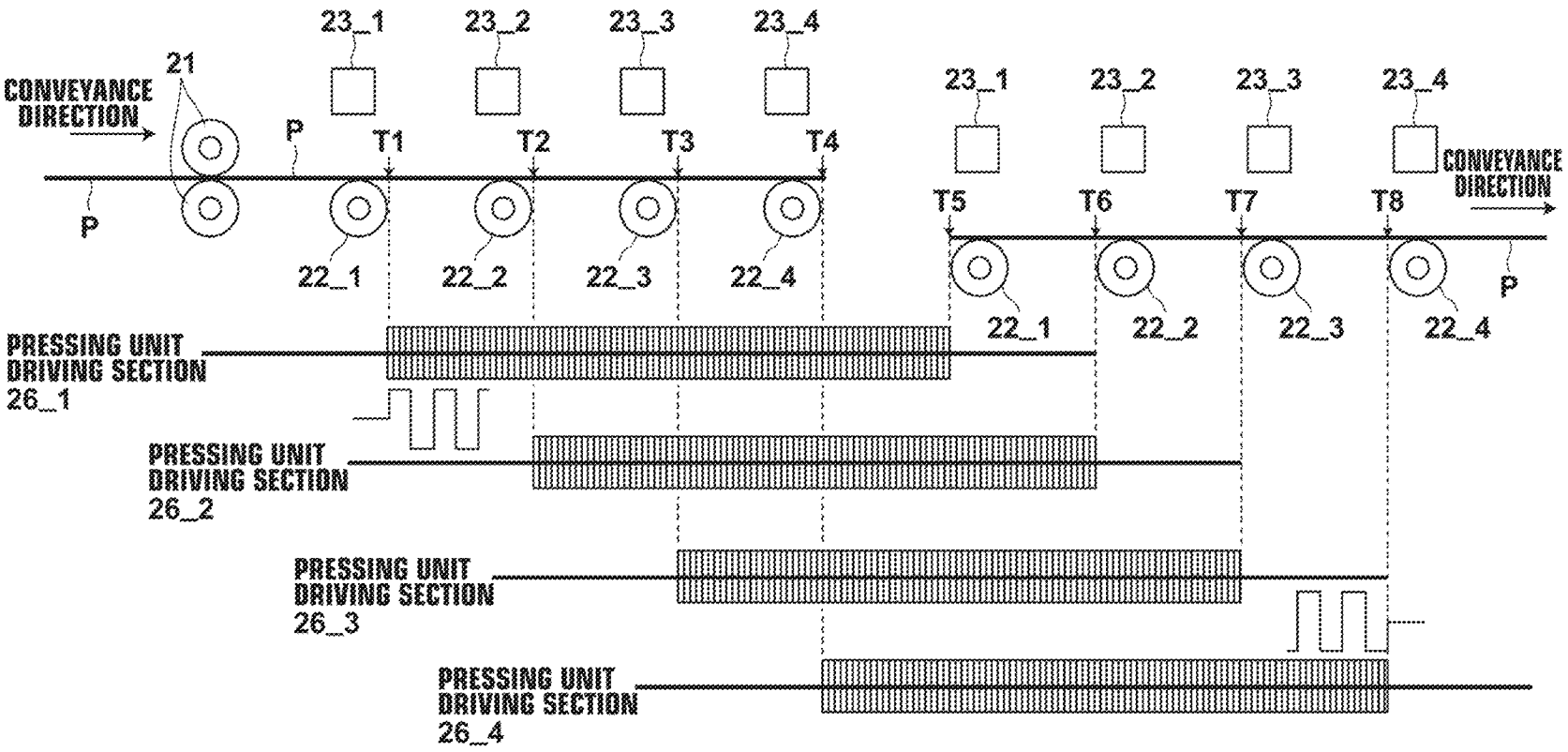
FIG. 10 is a diagram illustrating one example of timing to supply a drive voltage waveform from each pressing unit driving section to the corresponding pressing unit.

FIG. 10 shows one example of timing to supply the drive voltage waveform from each pressing unit driving section 26 to the corresponding pressing unit 23. In FIG. 10, the pressing units 23 are denoted as a pressing unit 23_1, a pressing unit 23_2, a pressing unit 23_3, and a pressing unit 23_4 in order from the most upstream-side pressing unit 23 in the conveyance direction of the printing paper sheet P, the conveying rollers 22 corresponding to the individual pressing units 23_1 to 23_4 are denoted as conveying rollers 22_1 to 22_4, respectively, and the pressing unit driving sections 26 that supply the drive voltages to the individual pressing units 23_1 to 23_4 are denoted as pressing unit driving sections 26_1 to 26_4, respectively.

As shown in FIG. 10, the pressing unit driving section 26_1 supplies the drive voltage to the pressing unit 23_1 for a time period from a point of time T1 after the leading edge of the printing paper sheet P conveyed by the nip rollers 21 reaches the central axis position of the conveying roller 22_1 to a point of time T5 immediately before the trailing edge of the printing paper sheet P passes through the central axis position of the conveying roller 22_1.

The pressing unit driving section 26_2 supplies the drive voltage to the pressing unit 23_2 for a time period from a point of time T2 after the leading edge of the printing paper sheet P conveyed by the conveying roller 22_1 reaches the central axis position of the conveying roller 22_2 to a point of time T6 immediately before the trailing edge of the printing paper sheet P passes through the central axis position of the conveying roller 22_2.

The pressing unit driving section 26_3 supplies the drive voltage to the pressing unit 23_3 for a time period from a point of time T3 after the leading edge of the printing paper sheet P conveyed by the conveying roller 22_2 reaches the central axis position of the conveying roller 22_3 to a point of time T7 immediately before the trailing edge of the printing paper sheet P passes through the central axis position of the conveying roller 22_3.

The pressing unit driving section 26_4 supplies the drive voltage to the pressing unit 23_4 for a time period from a point of time T4 after the leading edge of the printing paper sheet P conveyed by the conveying roller 22_3 reaches the central axis position of the conveying roller 22_4 to a point of time T8 immediately before the trailing edge of the printing paper sheet P passes through the central axis position of the conveying roller 22_4.

The timing to supply the drive voltage from each pressing unit driving section 26 to the corresponding pressing unit 23, as described above, is set based on the conveyance position of the printing paper sheet P being conveyed. To this end, as shown in FIG. 2, a paper leading edge detection sensor 71 that detects the leading edge of the printing paper sheet P having passed through the nip rollers 21, and a paper conveyance position calculating section 70 that calculates the conveyance position of the printing paper sheet P based on a detection signal from the paper leading edge detection sensor 71 and the number of rotations of a roller drive motor 72, which drives the nip rollers 21 and the conveying rollers 22, are provided in this embodiment. Based on the conveyance position of the printing paper sheet P calculated by the paper conveyance position calculating section 70, the press timing generating sections 27 output the waveform signals to the corresponding pressing unit driving sections 26. It should be noted that, in this embodiment, the paper leading edge detection sensor 71 and the paper conveyance position calculating section 70 described above correspond to a conveyance position detection unit of the invention.

In the case where emission of the ultrasound from the pressing units 23 is started in order from the most upstream-side pressing unit 23 to the most downstream-side pressing unit 23 in the conveyance direction and the emission of the ultrasound is stopped in order from the most upstream-side pressing unit 23 to the most downstream-side pressing unit 23 in the conveyance direction depending on the conveyance position of the printing paper sheet, as described above, the ultrasound is emitted only when it is necessary, and this allows reduction of power consumption.

As described above, pressing force of the ultrasound emitted from the pressing unit 23 toward the printing paper sheet P is dependent on the magnitude of the drive voltage supplied to the pressing unit 23 from the pressing unit driving section 26, and the magnitude of the drive voltage is dependent on the magnitude of the regulated voltage supplied to each pressing unit driving section 26 from the drive voltage regulating section 28 shown in FIG. 2.

Then, it is desirable that the pressing force applied to the printing paper sheet P from the pressing units 23 be changed depending on the thickness and/or resiliency of the printing paper sheet P. Specifically, for example, if an excessively high pressing force is applied to a thin printing paper sheet P that is not resilient, such as lightweight paper, the printing paper sheet P may be bent significantly, resulting in degradation of positional accuracy of printing. On the other hand, in a case of a heavy printing paper sheet P, such as a paper sheet for a testimonial, an insufficient pressing force may result in conveyance failure, such as slip on the conveying rollers 22.

Figures 11, 12:
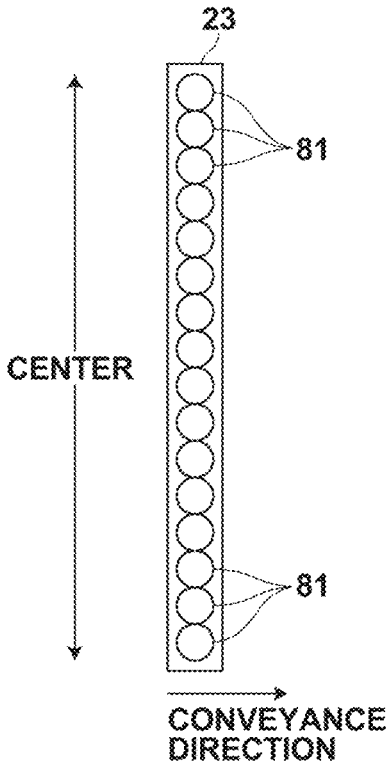
FIG. 11 shows one example of a table which associates information about printing paper with regulated voltage.
FIG. 12 is a diagram for explaining one example of a driving method for driving the ultrasound emitter elements included in the pressing unit.

To this end, in this embodiment, a table that associates different information about printing paper Pa to Pd with different magnitudes of regulated voltages V1 to V4 to be outputted from the drive voltage regulating section 28, as shown in FIG. 11, may be stored in a paper information storing section 29 shown in FIG. 2. Then, the paper press control unit 25 obtains the information about printing paper and references the table to control the drive voltage regulating section 28 to output the regulated voltage corresponding to the information about printing paper. It should be noted that the information about printing paper may be obtained from the print job data outputted from a computer, or may be set and inputted by the user via a control panel (not shown), which is formed by a touch panel, of the printing system 1.

Examples of the information about printing paper may include information about type of printing paper, such as lightweight paper, cardboard, etc., as described above, information about thickness of printing paper, information about size of printing paper, information about resiliency of printing paper, etc.

In a case where the information about printing paper is the information about thickness or the information about resiliency of printing paper, a higher regulated voltage may be supplied for a thicker printing paper sheet or a printing paper sheet with higher resiliency, and a lower regulated voltage may be supplied for a thinner printing paper sheet or a printing paper sheet with lower resiliency, for example, with taking bend, slip, etc., of the printing paper sheet into account, as described above. Also, since a thinner printing paper sheet or a printing paper sheet with lower resiliency is in less close contact with the conveying rollers 22 and is more likely to crease, a lower regulated voltage may be supplied for a thinner printing paper sheet, and a higher regulated voltage may be supplied for a thicker printing paper sheet or a printing paper sheet with higher resiliency.

In a case where the information about printing paper is the information about size of printing paper, a higher regulated voltage may be supplied for a larger printing paper sheet, and a lower regulated voltage may be supplied for a smaller printing paper sheet, for example. However, if a smaller printing paper sheet is more likely to slip on the conveying rollers 22, a higher regulated voltage may be supplied for a smaller printing paper sheet, and a lower regulated voltage may be supplied for a larger printing paper sheet.

Also, in a case where the information about printing paper is the information about type of printing paper, the regulated voltage is set depending on the thickness and/or resiliency of the printing paper sheet.

It should be noted that, while one pressing unit driving section 26 is provided for each pressing unit 23 in this embodiment, the pressing unit driving section 26 shown in FIG. 3 may be provided for each ultrasound emitter element 81 included in one pressing unit 23, for example, so that emission of the ultrasound from each ultrasound emitter element 81 can be independently controlled. In the case where each ultrasound emitter element 81 is independently controllable, emission of the ultrasound from a given pressing unit 23 at the timing described above may be controlled such that the ultrasound is emitted from the ultrasound emitter elements 81 of the pressing unit 23 in order from the ultrasound emitter element 81 at the center in the direction perpendicular to the conveyance direction to the ultrasound emitter elements 81 at the opposite ends (in the directions of the arrows shown in FIG. 12), as shown in FIG. 12, for example.

In the case where the ultrasound is emitted from the ultrasound emitter elements 81 in this manner, the pressing force can be applied to the printing paper sheet P from the center position toward the opposite ends in the direction perpendicular to the conveyance direction, and this allows eliminating or minimizing creasing of the printing paper sheet P.

Now, the effect of pressing the printing paper sheet P with the ultrasound emitted from the ultrasound emitter elements 81, as in this embodiment, is described in comparison with a case where the printing paper sheet P is pressed with wind from a fan, for example.

Figure 13A:
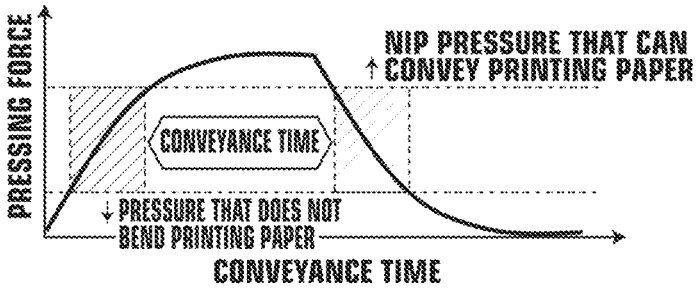
FIG. 13A is a diagram showing the relationship between pressing force of wind from a fan and conveyance time of a printing paper sheet.

In the case where a fan is used to press the printing paper sheet P, the relationship between the pressing force of the wind from the fan and the conveyance time of the printing paper sheet P is as shown in FIG. 13A. Namely, in the case where the wind generated by a fan is applied to the printing paper sheet P, the response speed of the fan when the application of the wind is started or stopped is relatively low, and it takes a relatively long time (the hatched area on the left) to raise the pressing force of the wind to a nip pressure that can convey the printing paper sheet P. Also, it takes a relatively long time (the hatched area on the right) to thereafter decrease the pressing force of the wind to a level that does not bend the printing paper sheet P. Thus, in the case where the printing paper sheet P is conveyed using the pressure of the wind, a conveyance time that can be ensured while the fan is operating is relatively short.

Figure 13B:
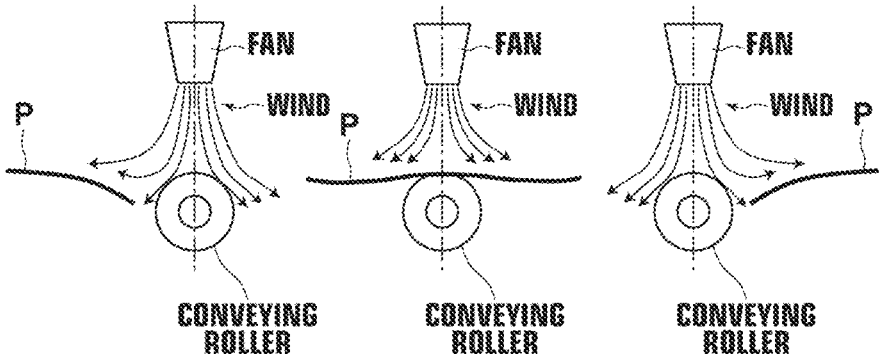
FIG. 13B is a diagram for explaining operation of pressing a printing paper sheet with the wind from the fan.

Further, the wind from a fan has low directivity, resulting in a wide pressure distribution on the printing paper sheet P. In this case, the printing paper sheet tends to be bent in the vicinity of the conveying roller, as shown in FIG. 13B, and this tends to lead to conveyance failure.

Figure 14A:
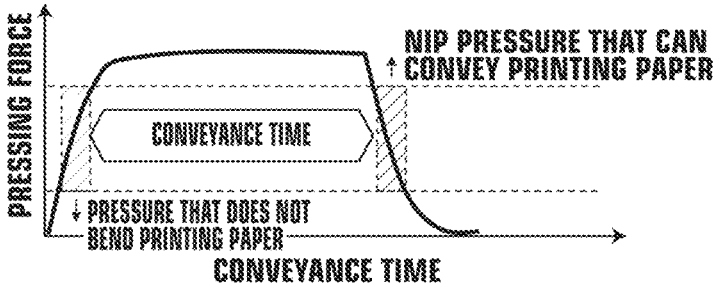
FIG. 14A is a diagram showing the relationship between pressing force of ultrasound emitted from the ultrasound emitter elements and conveyance time of a printing paper sheet.

On the other hand, in the case where the printing paper sheet P is pressed using the ultrasound emitter elements 81, as in this embodiment, the relationship between the pressing force of the ultrasound emitted from the ultrasound emitter elements 81 and the conveyance time of the printing paper sheet P is as shown in FIG. 14A. Namely, in the case where the ultrasound emitted from the ultrasound emitter elements 81 is applied to the printing paper sheet P, the response speed of the ultrasound emitter elements 81 when the application of the ultrasound is started or stopped is relatively high, and it takes a relatively short time (the hatched area on the left) to raise the pressing force of the ultrasound to a nip pressure that can convey the printing paper sheet P. Also, it takes a relatively short time (the hatched area on the right) to thereafter decrease the pressing force of the ultrasound to a level that does not bend the printing paper sheet P. Thus, in the case where the printing paper sheet P is conveyed using the pressure of the ultrasound emitted from the ultrasound emitter elements 81, a relatively long conveyance time can be ensured while the ultrasound emitter elements 81 are operating, and this allows improving processing efficiency of printing.

Figure 14B:
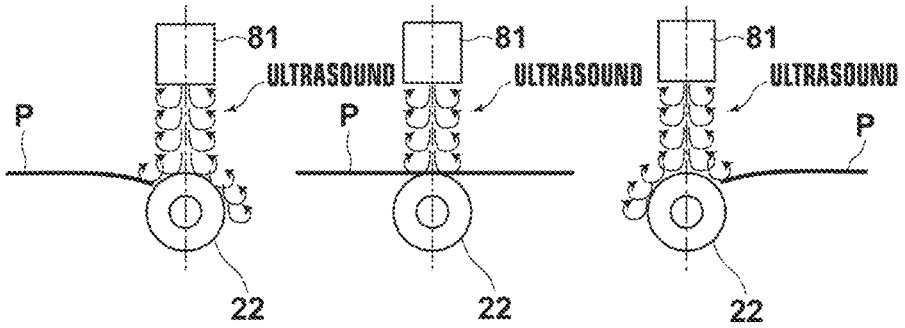
FIG. 14B is a diagram for explaining operation of pressing a printing paper sheet with ultrasound.

Further, the ultrasound emitted from the ultrasound emitter elements 81 has high directivity, resulting in a narrow pressure distribution on the printing paper sheet P. This allows minimizing bending of the printing paper sheet P in the vicinity of the conveying roller 22, as shown in FIG. 14B.

Pressing the printing paper sheet P with the ultrasound emitted from the ultrasound emitter elements 81 in this manner, rather than the wind from a fan, allows improving processing efficiency and eliminating or minimizing conveyance failure of the printing paper sheet P.

Figure 15A:
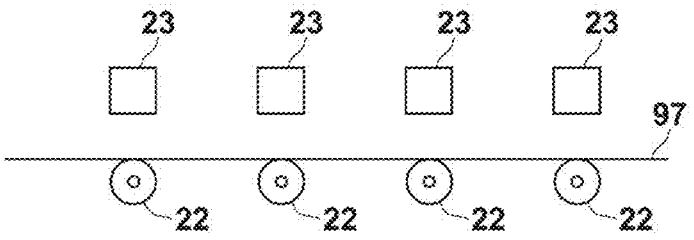
FIG. 15A is a diagram showing an example where a paper guide is provided on conveying rollers.
Figure 15B:
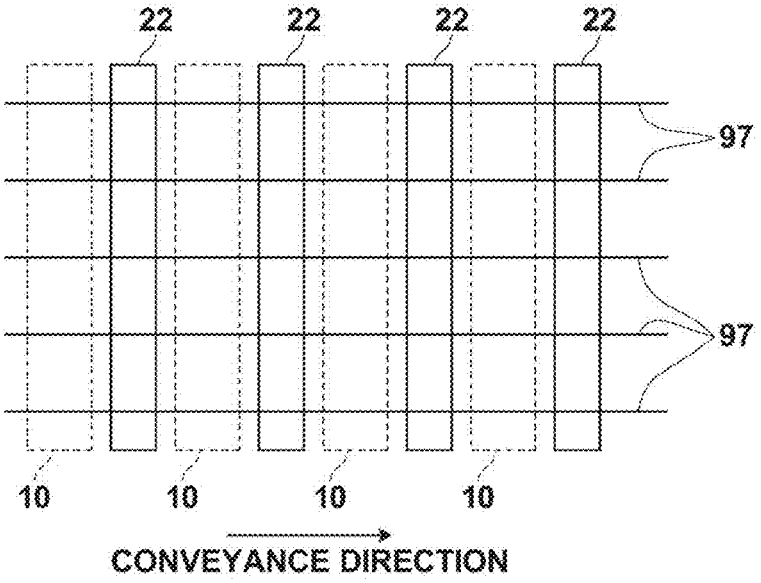
FIG. 15B shows the conveying rollers and the paper guide shown in FIG. 15A viewed from above.

In order to reliably prevent bending of the printing paper sheet P in the vicinity of the conveying roller 22, a paper guide 97 that is in contact with the conveying rollers 22 may be provided, as shown in FIG. 15A. For example, the paper guide 97 may be made of a plurality of thin wires, such as piano wires, which are arranged in parallel to the conveyance direction of the printing paper sheet P with being spaced apart from one another, as shown in FIG. 15B. FIG. 15B shows the paper guide 97 shown in FIG. 15A viewed from above, where the pressing units 23 are not shown.

Figure 16:
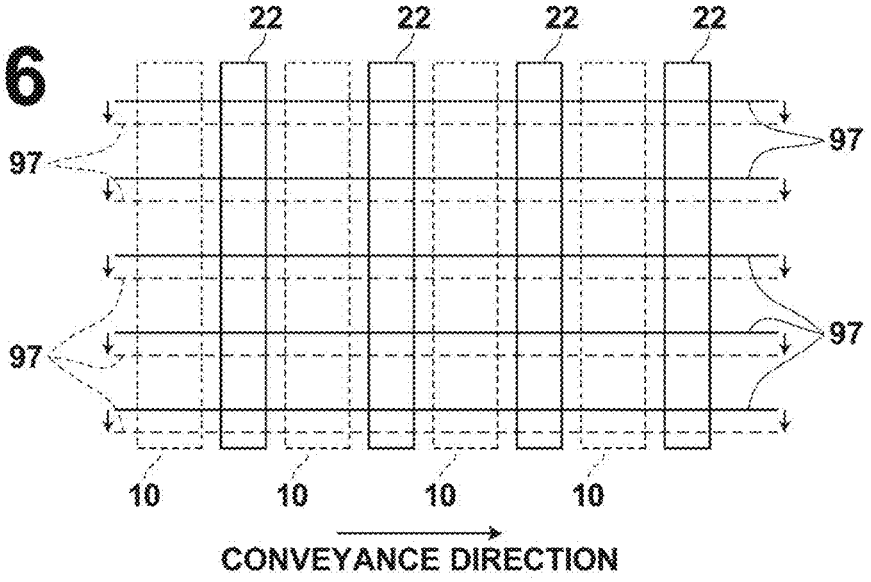
FIG. 16 is a diagram for explaining an example where the paper guide shown in FIGS. 15A and 15B is moved.

In the case where the paper guide 97 made of a plurality of wires is provided on the conveying rollers 22, as shown in FIG. 15B, however, ink ejected from each ink head of the ink head unit 10 disposed between the conveying rollers 22 adheres to the paper guide 97 when no printing paper sheet P is present on the paper guide 97, such as during cleaning of the ink head unit 10, for example, and may contaminate the next printing paper sheet P conveyed thereto. Therefore, the paper guide 97 may be adapted to be movable in the direction perpendicular to the conveyance direction, for example. In this case, when the paper guide 97 is in a first position shown by the solid lines in FIG. 16, control may be exerted such that ink is not ejected from groups of nozzles of the ink head unit 10 at positions facing the wires of the paper guide 97 in the first position, and ink is ejected only from groups of nozzles other than the groups of nozzles facing the wires of the paper guide 97. Thereafter, the paper guide 97 is moved from the first position to a second position shown by the dashed lines in FIG. 16, and ink is ejected from the groups of nozzles at the positions facing the wires of the paper guide 97 in the first position.

Figure 17:
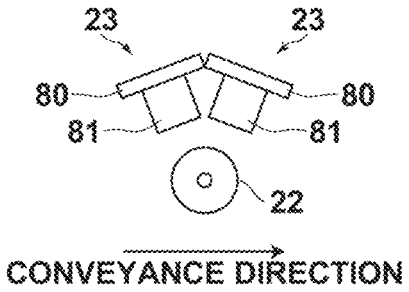
FIG. 17 is a diagram showing an example where two pressing units are provided for one conveying roller.

It should be noted that, while one pressing unit 23 is provided for each conveying roller 22 in the printing system 1 of the above-described embodiment, a plurality of pressing units 23 may be provided for each conveying roller 22. For example, as shown in FIG. 17, two pressing units 23 may be provided for each conveying roller 22. In this case, as shown in FIG. 17, it is desirable that each pressing unit 23 be inclined such that the ultrasound emitted from each pressing unit 23 is directed to the central axis of the conveying roller 22. Providing the plurality of pressing units 23 for each conveying roller 22 allows pressing the printing paper sheet P with a higher pressure.

The above description is the explanation of the configuration and the control system of the paper conveyance section 12 of the printing system 1 of this embodiment.

Next, details of the first conveyance path switching section 24, the second conveyance path switching section 33 and the third conveyance path switching section 53 are described. First, the second conveyance path switching section 33 is described.

As shown in FIG. 1, the second conveyance path switching section 33 is disposed in the middle of the top side conveyance section 13, namely, at the branch point between the conveyance path toward the first paper output section 14 and the conveyance path toward the inverting section 15. The second conveyance path switching section 33 emits ultrasound toward the printing paper sheet P conveyed from the downstream side to press the printing paper sheet P, thereby switching the conveyance path, to which the printing paper sheet P is directed, between the conveyance path toward the first paper output section 14 and the conveyance path toward inverting section 15.

Figure 18:
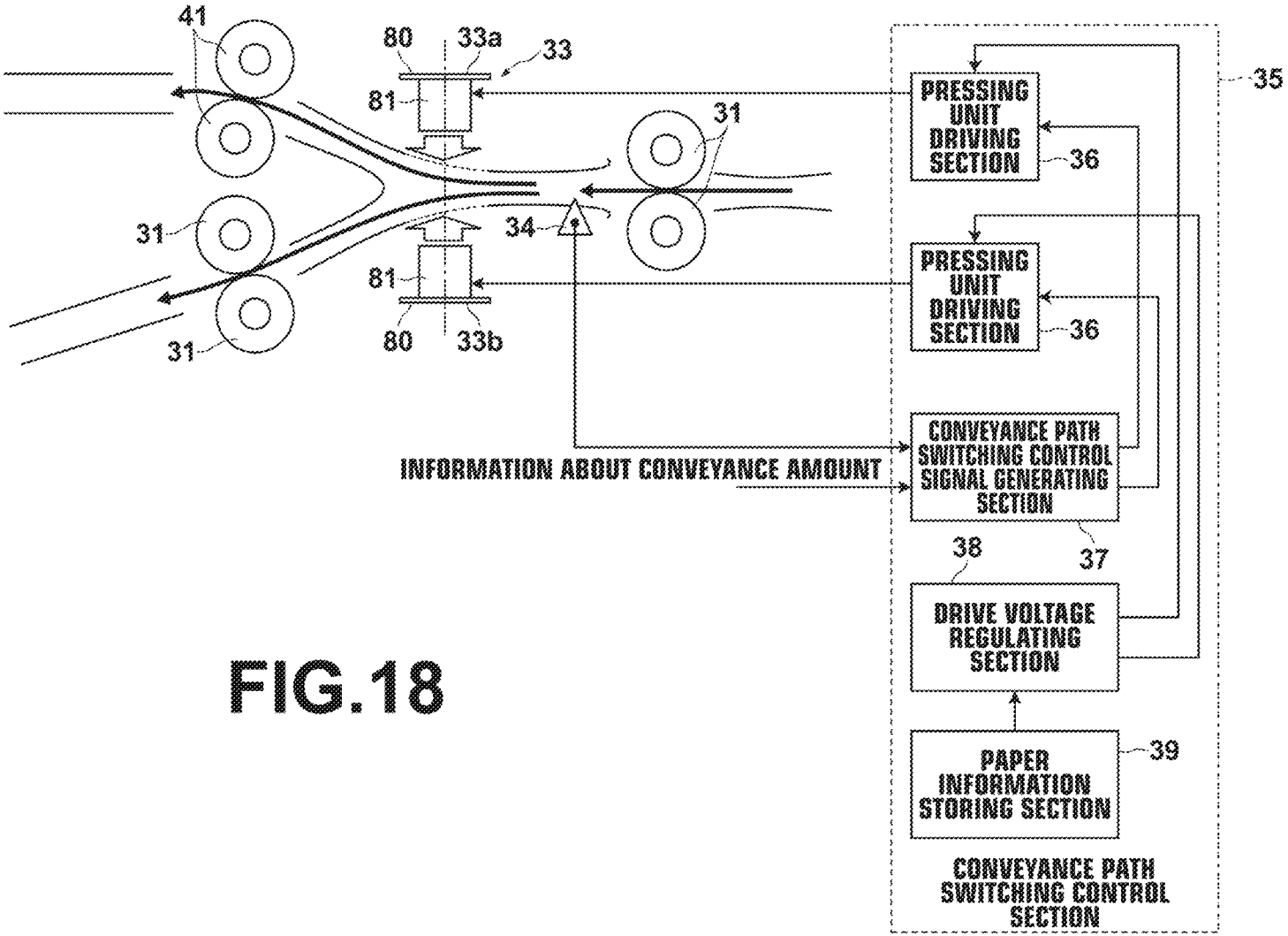
FIG. 18 is a diagram illustrating the configuration of a second conveyance path switching section and a control system thereof.

Specifically, as shown in FIG. 18, the second conveyance path switching section 33 includes a first pressing unit 33*a* and a second pressing unit 33*b*. The first pressing unit 33*a* and the second pressing unit 33*b* are disposed to sandwich the branch point between the conveyance path toward the first paper output section 14 and the conveyance path toward the inverting section 15. The first pressing unit 33*a* emits ultrasound downward, and the second pressing unit 33*b* emits ultrasound upward.

The configuration of each of the first pressing unit 33*a* and the second pressing unit 33*b* is the same as that of the above-described pressing unit 23 of the paper conveyance section 12. Namely, each of the first pressing unit 33*a* and the second pressing unit 33*b* includes the substrate 80, and the plurality of ultrasound emitter elements 81 that are arranged along the direction perpendicular to the conveyance direction of the printing paper sheet P. The ultrasound emitter elements 81 of the first pressing unit 33*a* and the ultrasound emitter elements 81 of the second pressing unit 33*b* are also driven to emit ultrasound of an identical frequency and an identical phase.

Driving of the second conveyance path switching section 33 is controlled by a conveyance path switching control section 35 shown in FIG. 18.

The conveyance path switching control section 35 includes pressing unit driving sections 36 that control driving of the first pressing unit 33*a* and the second pressing unit 33*b*, respectively. Each pressing unit driving sections 36 supplies a drive voltage to the ultrasound emitter elements 81 of corresponding one of the first and the second pressing units 33*a* and 33*b*. That is, the pressing unit driving section 36 is provided for each of the first pressing unit 33*a* and the second pressing unit 33*b*, so that driving of the first pressing unit 33*a* and the second pressing unit 33*b* can be controlled independently from each other. The detailed configuration of the pressing unit driving section 36 is the same as that of the above-described pressing unit driving section 26 of the paper press control unit 25.

Further, the conveyance path switching control section 35 includes a conveyance path switching control signal generating section 37. The conveyance path switching control signal generating section 37 generates and outputs a rectangular waveform signal having a frequency of 40 kHz and a duty cycle of 50%, similarly to the above-described press timing generating section 27 of the paper press control unit 25. When the waveform signal outputted from the conveyance path switching control signal generating section 37 is inputted to the pressing unit driving section 36 provided for the first or the second pressing unit 33*a* or 33*b*, a drive voltage in the positive direction and a drive voltage in the negative direction are alternately supplied to the first or the second pressing unit 33*a* or 33*b* from the pressing unit driving section 36 to control the emission of the ultrasound.

Further, a paper leading edge detection sensor 34 that detects the leading edge of the printing paper sheet P being conveyed is disposed on the upstream side in the vicinity of the second conveyance path switching section 33. The above-described conveyance path switching control signal generating section 37 outputs the waveform signal to each pressing unit driving section 36 at timing based on a detection signal from the paper leading edge detection sensor 34, and information about conveyance amount of the printing paper sheet P. The information about conveyance amount of the printing paper sheet P represents a conveyance amount of the printing paper sheet P from a point of time when the leading edge of the printing paper sheet P is detected by the paper leading edge detection sensor 34. The information about conveyance amount of the printing paper sheet P is calculated based on the number of rotations of the motor that drives the top side conveying rollers 31.

Next, control exerted when the conveyance path of the printing paper sheet P is switched by the second conveyance path switching section 33 is described with reference to FIGS. 18, 19 and 20.

Figure 19:
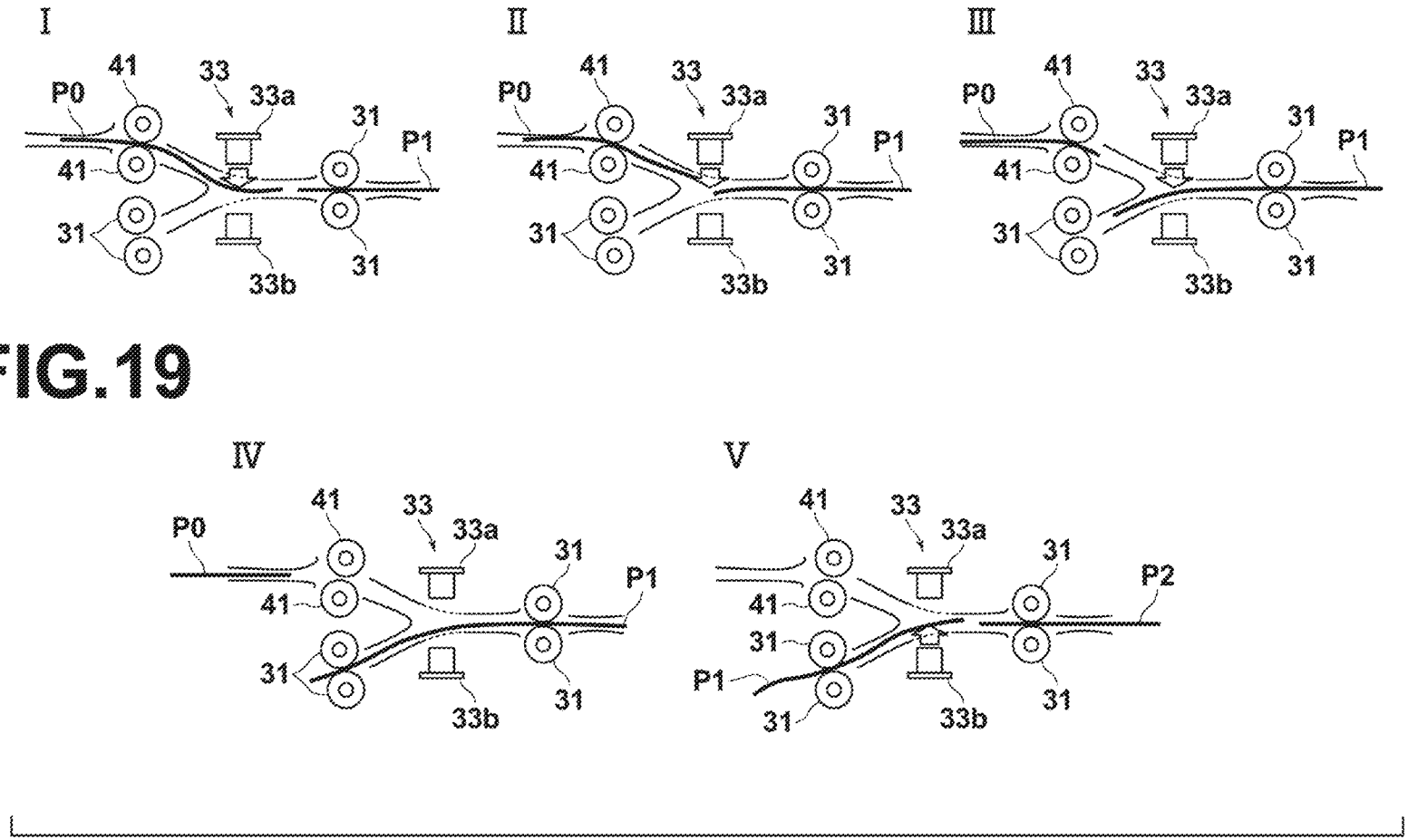
FIG. 19 is a diagram for explaining timing to start emission of ultrasound and timing to stop the emission of the ultrasound from first and second pressing units in time order.
Figure 20:
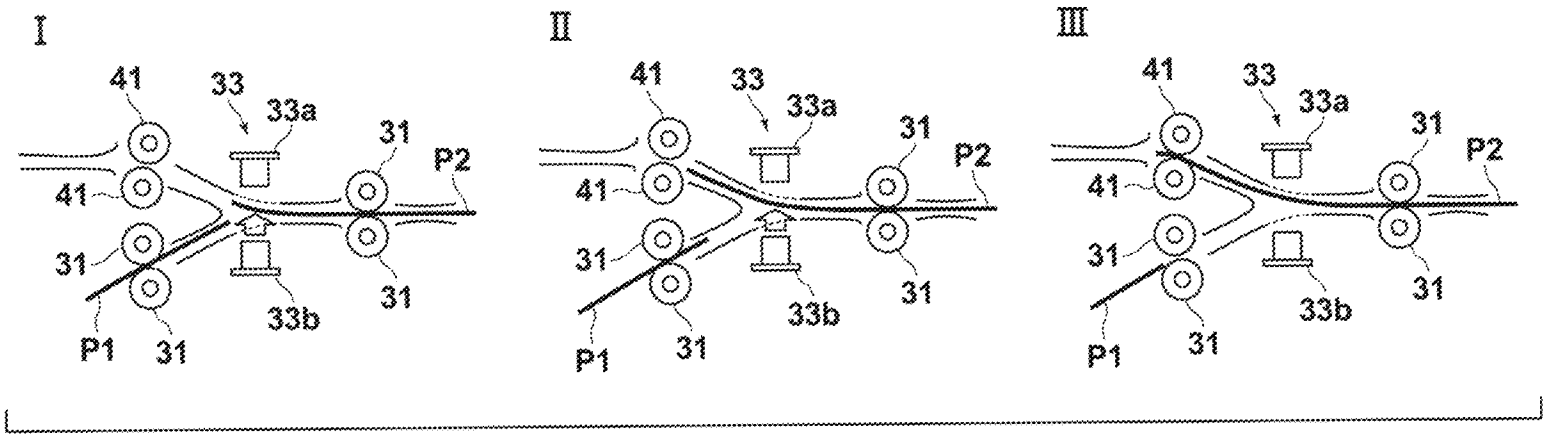
FIG. 20 is a diagram for explaining the timing to start emission of the ultrasound and the timing to stop the emission of the ultrasound from the first and the second pressing units in time order.

FIG. 19 (I to V) and FIG. 20 (I to III) are diagrams for explaining timing to start the emission of the ultrasound and timing to stop the emission of the ultrasound from the first and the second pressing units 33*a* and 33*b* in time order. The order of the states shown at I to V in FIG. 19 and at I to III in FIG. 20 corresponds to the time order. Now, a case where the conveyance path is alternately switched between the conveyance path toward the first paper output section 14 and the conveyance path toward the inverting section 15 is described.

First, as shown at I in FIG. 19, the emission of the ultrasound from the first pressing unit 33*a* is started at a point of time when the trailing edge of the preceding printing paper sheet P0 being conveyed reaches the second conveyance path switching section 33, and the leading edge of the next printing paper sheet P1 being conveyed is at a position just in front of the second conveyance path switching section 33. At this time, no ultrasound is emitted from the second pressing unit 33*b*.

Then, as shown at II in FIG. 19, at a point of time when the trailing edge of the preceding printing paper sheet P0 being conveyed has passed through the second conveyance path switching section 33 and the leading edge of the next printing paper sheet P1 reaches the second conveyance path switching section 33, the emission of the ultrasound from the first pressing unit 33*a* is continued to guide the leading edge of the next printing paper sheet P1 to the conveyance path toward the inverting section 15. Then, as shown at III in FIG. 19, the emission of the ultrasound from the first pressing unit 33*a* is continued and the printing paper sheet P1 is guided onto the conveyance path toward the inverting section 15.

Then, as shown at IV in FIG. 19, the emission of the ultrasound from the first pressing unit 33*a* is stopped when the printing paper sheet P1 has been conveyed on the conveyance path toward the inverting section 15 by a distance that is set in advance.

Then, as shown at V in FIG. 19, the emission of the ultrasound from the second pressing unit 33*b* is started at a point of time where the trailing edge of printing paper sheet P1 being conveyed reaches the second conveyance path switching section 33. At this time, the leading edge of the next printing paper sheet P2 being conveyed is at a position just in front of the second conveyance path switching section 33.

As shown at I in FIG. 20, at a point of time when the trailing edge of printing paper sheet P1 has passed through the second conveyance path switching section 33 and the leading edge of the next printing paper sheet P2 reaches the second conveyance path switching section 33, the emission of the ultrasound from the second pressing unit 33*b* is continued to guide the leading edge of the next printing paper sheet P2 to the conveyance path toward the first paper output section 14. Then, as shown at II in FIG. 20, the emission of the ultrasound from the second pressing unit 33*b* is continued and the printing paper sheet P2 is guided onto the conveyance path toward the first paper output section 14.

Then, as shown at III in FIG. 20, the emission of the ultrasound from the second pressing unit 33*b* is stopped when the printing paper sheet P2 has been conveyed on the conveyance path toward the first paper output section 14 by a distance that is set in advance. The above-described operations shown at I to V in FIG. 19 and at I to III in FIG. 20 are repeated.

Further, as shown in FIG. 18, the conveyance path switching control section 35 includes a drive voltage regulating section 38 and a paper information storing section 39. The drive voltage regulating section 38 supplies the regulated voltage to each pressing unit driving section 36, similarly to the above-described drive voltage regulating section 28 of the paper press control unit 25.

The paper information storing section 39 stores a table that associates different information about printing paper with different magnitudes of regulated voltages to be outputted from the drive voltage regulating section 38, similarly to the paper information storing section 29 of the paper press control unit 25. The conveyance path switching control section 35 obtains the information about printing paper and references the table to control the drive voltage regulating section 38 to output the regulated voltage corresponding to the information about printing paper.

As described above, examples of the information about printing paper may include the information about thickness of printing paper, the information about size of printing paper, the information about resiliency of printing paper, the information about type of printing paper, etc. In a case where the information about printing paper is the information about thickness or the information about resiliency of printing paper, a higher regulated voltage may be supplied for a thicker printing paper sheet or a printing paper sheet with higher resiliency, and a lower regulated voltage may be supplied for a thinner printing paper sheet or a printing paper sheet with lower resiliency, for example. It is desirable that the magnitude of the regulated voltage be set such that a frictional force between the conveyance path and the printing paper sheet P when the printing paper sheet P is pressed with the ultrasound is not greater than a predetermined value.

In a case where the information about printing paper is the information about size of printing paper, a higher regulated voltage may be supplied for a larger printing paper sheet, and a lower regulated voltage may be supplied for a smaller printing paper sheet, for example.

In a case where the information about printing paper is the information about type of printing paper, the regulated voltage may be set depending on the thickness and/or resiliency of the printing paper sheet.

Next, the first conveyance path switching section 24 is described. The first conveyance path switching section 24 switches the conveyance path, to which the printing paper sheet P conveyed by the conveying rollers 22 is directed, between the conveyance path of the top side conveyance section 13 and the conveyance path of the second paper output section 16, as described above.

The configuration of the first conveyance path switching section 24 is the same as that of the second conveyance path switching section 33, and the first conveyance path switching section 24 includes a first pressing unit 24*a* and a second pressing unit 24*b*, as shown in FIG. 1. The first pressing unit 24*a* and the second pressing unit 24*b* are disposed to sandwich the branch point between the conveyance path of the second paper output section 16 and the conveyance path of the top side conveyance section 13. The first pressing unit 24*a* emits ultrasound downward, and the second pressing unit 24*b* emits ultrasound upward. The configuration of the first pressing unit 24*a* and the second pressing unit 24*b* is the same as that of the above-described first pressing unit 33*a* and second pressing unit 33*b*.

Further, a paper leading edge detection sensor (not shown) is disposed on the upstream side in the vicinity of the first conveyance path switching section 24. Based on a detection signal from the paper leading edge detection sensor and the information about conveyance amount of the printing paper sheet P, the conveyance path switching control section controls driving of the first pressing unit 24*a* and the second pressing unit 24*b*. When the printing paper sheet P is guided to the conveyance path of the second paper output section 16, the conveyance path switching control section controls the first pressing unit 24*a* to emit the ultrasound. On the other hand, when the printing paper sheet P is guided to the conveyance path of the top side conveyance section 13, the conveyance path switching control section controls the second pressing unit 24*b* to emit the ultrasound. The configuration of the conveyance path switching control section and the control exerted by the conveyance path switching control section to switch the conveyance path are the same as those of the above-described conveyance path switching control section 35.

Next, details of the third conveyance path switching section 53 are described. When the printing paper sheet P temporarily received by the switchback section 52, as described above, is discharged from the switchback section 52, the third conveyance path switching section 53 emits ultrasound toward the leading edge of the printing paper sheet P to press the leading edge, thereby guiding the leading edge of the printing paper sheet P to the conveyance path toward the nip rollers 21.

As shown in FIG. 1, the third conveyance path switching section 53 is disposed in the vicinity of the inverting rollers 51 of the inverting section 15, and emits ultrasound downward. The configuration of the third conveyance path switching section 53 is the same as that of the first and second conveyance path switching sections, except that the third conveyance path switching section 53 is provided with only one pressing unit, which has the same configuration as that of the first pressing unit 33*a* and the first pressing unit 24*a* described above.

Further, a paper leading edge detection sensor is disposed on the upstream side in the vicinity of the third conveyance path switching section 53. Based on a detection signal from the paper leading edge detection sensor and the information about conveyance amount of the printing paper sheet P, the conveyance path switching control section controls driving of the third conveyance path switching section 53. The configuration of the conveyance path switching control section of the third conveyance path switching section 53 is the same as that of the conveyance path switching control section 35, except that only one pressing unit driving section is provided.

At a point of time when the leading edge of the printing paper sheet P temporarily received by the switchback section 52 reaches the third conveyance path switching section 53, a conveyance path switching control signal generating section of the conveyance path switching control section of the third conveyance path switching section 53 outputs a waveform signal to the pressing unit driving section. In response to the waveform signal, the pressing unit driving section outputs a drive voltage to the third conveyance path switching section 53, and ultrasound is emitted from the third conveyance path switching section 53.

Similarly to the first and the second conveyance path switching sections 24 and 33, the drive voltage supplied to the third conveyance path switching section 53 may be changed depending on the information about printing paper.

Now, the effect of switching the conveyance path by pressing the printing paper sheet P with the ultrasound, as in this embodiment, is described in comparison with a case where the switching of the conveyance path is achieved by pressing the printing paper sheet P with wind from a fan, for example.

In the case where the switching of the conveyance path is achieved by pressing the printing paper sheet P by using a fan, wind from the fan tends to be rough air flow, and it is very difficult to realize wind paths that can apply a uniform wind pressure across the entire width of the printing paper sheet P.

Figure 21A:
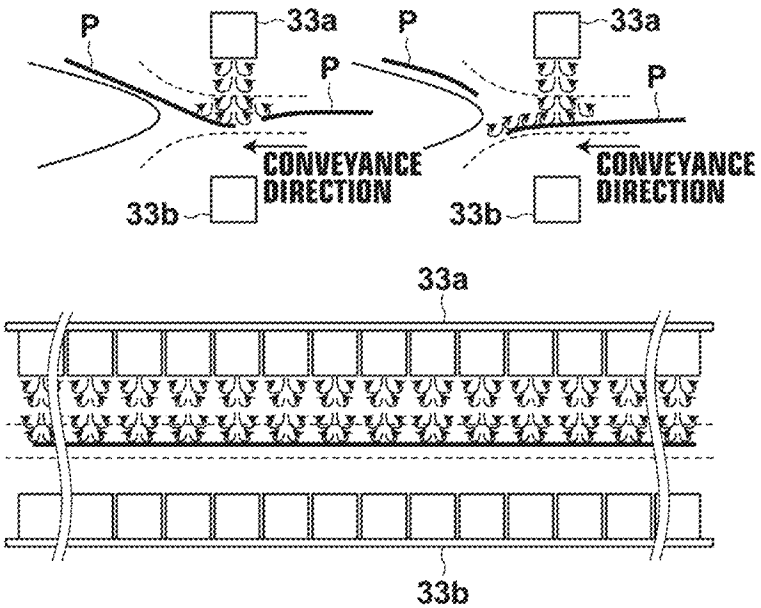
FIG. 21A is a diagram for explaining operation in a case where switching of a conveyance path is achieved by pressing a printing paper sheet with ultrasound.
Figure 21B:
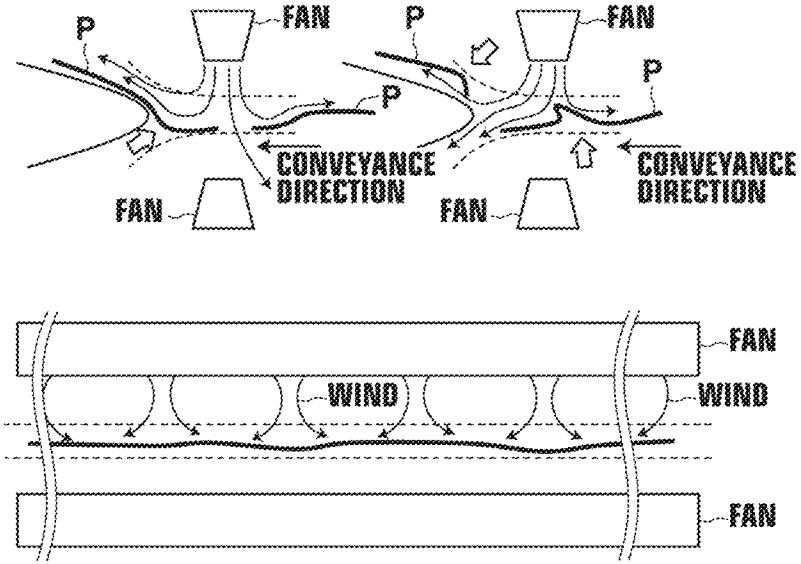
FIG. 21B is a diagram for explaining operation in a case where switching of a conveyance path is achieved by pressing a printing paper sheet with wind from a fan.

Therefore, the printing paper sheet P is likely to crease at the areas indicated by the outline arrows shown in FIG. 21B. It should be noted that the diagram shown at the bottom in FIG. 21B is a sectional view perpendicular to the conveyance direction.

On the other hand, as shown in FIG. 21A, in the case where the switching of the conveyance path is achieved by pressing the printing paper sheet P with ultrasound, as in this embodiment, ultrasound waves with high directivity emitted from the individual ultrasound emitter elements are arranged in an array, and uniform pressure waves can be formed. This allows minimizing creasing of the printing paper sheet P even when it is a relatively lightweight printing paper sheet P. It should be noted that the diagram shown at the bottom in FIG. 21A is a sectional view perpendicular to the conveyance direction.

Pressing the printing paper sheet P with the ultrasound in this manner, rather than the wind from a fan, can minimize creasing of the printing paper sheet P, thereby reducing conveyance failure.

Next, operation of the printing system 1 of this embodiment is described with reference to FIG. 1.

First, the printing system 1 receives print job data that is outputted from a computer or read image data that is photoelectrically read at an original reading unit, and feeding of a printing paper sheet P, on which printing is performed according to the print job data or the read image data, is started.

Specifically, each printing paper sheet P placed on the paper feeding tray 11*a* of the paper feeding section 11 is picked up by the pick-up rollers 18 and conveyed to the registration rollers 19. Then, the leading edge of the printing paper sheet P is once stopped at the registration rollers 19 to perform skew correction, and then the printing paper sheet P is conveyed to the paper conveyance section 12 at predetermined timing.

The printing paper sheet P conveyed by the registration rollers 19 is nipped and conveyed by the nip rollers 21 of the paper conveyance section 12, and then is conveyed by the conveying rollers 22 from the upstream side to the downstream side of the ink head unit 10.

At this time, as described above, ultrasound is emitted from the pressing units 23 in turn from the most upstream-side pressing unit 23 depending on the conveyance position of the printing paper sheet P, and the printing paper sheet P is pressed with the emitted ultrasound against the conveying rollers 22 and is conveyed by the conveying rollers 22.

Then, in the case where the printing paper sheet P is discharged to the second paper output section 16, the first pressing unit 24*a* of the first conveyance path switching section 24 emits ultrasound when the leading edge of the printing paper sheet P reaches the first conveyance path switching section 24. Thus, the leading edge of the printing paper sheet P is pressed downward and is guided by the second paper output section guide 61. Then, the printed printing paper sheet P is conveyed by the second paper output roller 62 and is discharged onto the second paper output tray 63.

On the other hand, in the case where the printed printing paper sheet P is discharged to the first paper output section 14 or inverted at the inverting section 15 for duplex printing, the second pressing unit 24*b* of the first conveyance path switching section 24 emits ultrasound when the leading edge of the printing paper sheet P reaches the first conveyance path switching section 24. Thus, the leading edge of the printing paper sheet P is pressed upward and is guided by the top side paper guide 32. Then, the printed printing paper sheet P is conveyed by the top side conveying rollers 31.

Then, in the case where the printed printing paper sheet P is discharged to the first paper output section 14, the second pressing unit 33*b* of the second conveyance path switching section 24 emits ultrasound when the printed printing paper sheet P reaches the second conveyance path switching section 33. Thus, the leading edge of the printing paper sheet P is pressed upward and guided by the first paper output section guide 42. Then, the printed printing paper sheet P is conveyed by the first paper output rollers 41 and discharged onto the first paper output tray 43.

On the other hand, in the case where the printed printing paper sheet P is inverted at the inverting section 15 for duplex printing, the first pressing unit 33*a* of the second conveyance path switching section 24 emits ultrasound. Thus, the leading edge of the printing paper sheet P is pressed downward and guided by the top side paper guide 32 toward the inverting section 15.

Then, the printing paper sheet P conveyed by the top side conveying rollers 31 is guided to the inverting rollers 51 and conveyed by the inverting rollers 51 into the switchback section 52, where the printing paper sheet P is temporarily received. Thereafter, the printing paper sheet P is conveyed out of the switchback section 52 by the inverting rollers 51, and the third conveyance path switching section 53 emits ultrasound downward to press the leading edge of the printing paper sheet P so that the leading edge of the printing paper sheet P is guided by the inverting paper guide 54. Then, the printing paper sheet P is guided by the inverting paper guide 54 to the registration rollers 19. After the skew correction at the registration rollers 19, the printing paper sheet P is conveyed by the registration rollers 19 to the nip rollers 21, and is again fed to the paper conveyance section 12 by the nip rollers 21. At this time, the printing paper sheet P has been inverted at the inverting section 15 and the unprinted side of the printing paper sheet P faces the ink head unit 10.

Then, the one side printed printing paper sheet P is conveyed by the paper conveyance section 12, and printing is performed on the unprinted side of the printing paper sheet P by the ink head unit 10. Thereafter, the printing paper sheet P having been subjected to duplex printing is guided to the second paper output section 16 by the ultrasound emitted from the first pressing unit 24*a* of the first conveyance path switching section 24 and is discharged onto the second paper output tray 63.

Further, cleaning of the ink head unit 10 by the cleaning units 17 is performed at timing according to an instruction inputted by the user to the computer or the printing system 1. In the printing system 1 of this embodiment, each cleaning unit 17 is disposed right below each ink head of the ink head unit 10, as shown in FIG. 1, and the cleaning can be performed immediately in response to an instruction by the user without moving the cleaning units 17. The timing of cleaning may be when an unused time or a continuous use time exceeds a predetermined time, or the number of times of continuous printing exceeds a predetermined number, for example.

That is, in an arrangement where the printing paper sheet P is conveyed by a conveying belt and conveying rollers, for example, as in conventional inkjet printer systems, the conveying belt is disposed right below the ink head unit, and the cleaning unit cannot be disposed right below the ink head unit, unlike the arrangement where the printing paper sheet P is conveyed by the conveying rollers 22 and the pressing units 23, as in this embodiment. Therefore, a large mechanism for changing the positions of the conveying belt and the cleaning unit is necessary to perform cleaning, and this leads to cost increase and size increase of the system.

Further, in an arrangement where a conveying belt provided with holes is used to convey the printing paper sheet with holding the printing paper sheet by suctioning air, the conveying belt itself is subjected to the pressure in the direction of suction. This is a large loss load relative to the conveyance direction and necessitates a large conveyance motor. Also, the need of forming the large number of holes in the conveying belt introduces a problem of degradation of durability.

Further, in the arrangement where the printing paper sheet is conveyed by the conveying belt, the width of the conveying belt is greater than the width of the printing paper sheet. In order to prevent adhesion of ink ejected from the ink head unit onto the area of the conveying belt outside the printing paper sheet, it is necessary to limit the printable area on the printing paper sheet by setting large page margins, for example.

In contrast, according to the printing system 1 of this embodiment where the printing paper sheet P is conveyed by the conveying rollers 22 and the pressing units 23, the cleaning units 17 can be disposed right below the ink heads, and it is not necessary to provide the above-described mechanism for changing the positions of the conveying belt and the cleaning unit. This allows cost reduction and size reduction of the system.

Further, in the case where the printing paper sheet P is conveyed by the conveying rollers 22 and the pressing units 23, there is no pressure that becomes a load relative to the conveyance direction of the printing paper sheet, unlike the system where suction is applied to the conveying belt, and therefore a low torque motor can be used. Further, since only the cleaning units 17 are present right below the ink heads, it is not necessary to limit the printable area and printing can be performed on the entire surface of the printing paper sheet, unlike the case where the conveying belt is used.

It should be noted that, although the problems occurring in the cases where the printing paper sheet is conveyed by the conveying belt and the conveying rollers and where the printing paper sheet is conveyed by suctioning air through the holes provided in the conveying belt are described above, the present invention does not exclude an arrangement where the printing paper sheet is conveyed by a combination of a conveying belt and the above-described embodiment pressing units 23. Conveyance of the printing paper sheet can also be achieved with an arrangement where the pressing units 23 of the above-described embodiment are disposed above the conveying belt. This arrangement can also prevent the retransfer of the ink since the printed surface is not brought into direct contact with conveying rollers.

Figure 22:
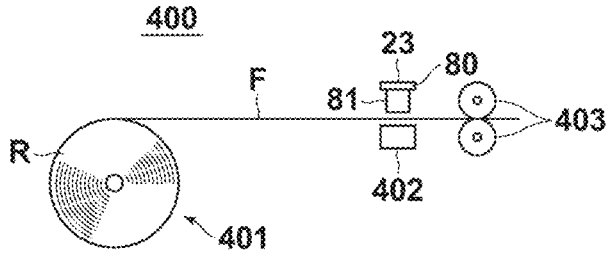
FIG. 22 is a diagram showing an example where the pressing unit is applied to a stencil printing master conveyance section.

While the pressing unit 23 including the ultrasound emitter elements 81 is applied to the paper conveyance section 12 of the printing system 1 in the above-described embodiment, the pressing unit 23 may be applied to other types of systems. Specifically, the pressing unit 23 is applicable to a stencil printing master conveyance section for conveying a stencil printing master of a stencil printing system, for example. FIG. 22 shows the pressing unit 23 applied to a stencil printing master conveyance section 400. The stencil printing master conveyance section 400 includes: a stencil printing master placement section 401 where a stencil printing master roll R is placed; a thermal head 402 that performs perforation based on print data on a stencil printing master F that is pulled from the stencil printing master roller R; and conveying rollers 403 that convey the stencil printing master F having been subjected to the perforation at the thermal head 402.

In the stencil printing master conveyance section 400, the above-described pressing unit 23 is disposed at a position facing the thermal head 402 such that the stencil printing master F is conveyed between the pressing unit 23 and the thermal head 402. When a drive voltage is supplied to the pressing unit 23, the ultrasound emitter elements 81 of the pressing unit 23 emit non-linear ultrasound, thereby pressing the stencil printing master F against the thermal head 402. This pressure brings the stencil printing master F in close contact with the thermal head 402, allowing appropriate perforation.

In a conventional stencil printing master conveyance section, the stencil printing master is conveyed by a platen roller, which is disposed to face the thermal head, with being pressed against the thermal head by the platen roller. However, the thermal head has a planar surface made of hard glass, and there is a problem of slip of the stencil printing master nipped between the platen roller and the thermal head. In particular, when the amount of the remaining stencil printing master roll R is low, tension applied from the stencil printing master roll R becomes higher, causing more slip.

In contrast, in the case where the stencil printing master is pressed against the thermal head 402 using the pressing unit 23 which is not in contact with the stencil printing master and conveyance of the stencil printing master is achieved using the conveying rollers 403 disposed downstream the thermal head 402, as in the above-described stencil printing master conveyance section 400, the above-described slip problem can be eliminated.

Figure 23:
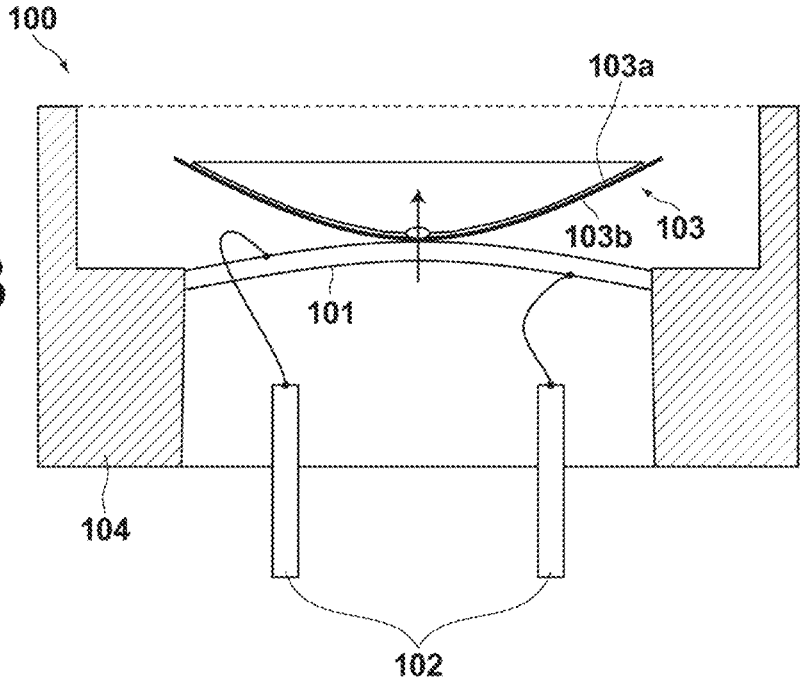
FIG. 23 is a cross-sectional view illustrating the structure of one embodiment of the ultrasound emitter element of the invention.

It should be noted that, while MA40S4S (available from Murata Manufacturing Co., Ltd.) is used as the ultrasound emitter elements 81 in the above-described embodiment, this is not intended to limit the invention, and other types of ultrasound emitter elements may be used as the ultrasound emitter elements 81. Now, one embodiment of an ultrasound emitter element having a more preferred configuration for pressing the printing paper sheet P with ultrasound, as described above, is described. FIG. 23 is a cross-sectional view illustrating the structure of an ultrasound emitter element 100 of this embodiment.

As shown in FIG. 23, the ultrasound emitter element 100 of this embodiment includes: a piezoelectric unimorph 101 that alternately deforms into a convex shape and a concave shape to achieve vibration-like motion when positive and negative drive voltages are alternately supplied; a parabola-shaped vibration plate 103 disposed on the piezoelectric unimorph 101; a housing 104 in which the piezoelectric unimorph 101 is secured; and drive voltage application terminals 102 through which the positive and negative drive voltages are supplied to the piezoelectric unimorph 101. The vibration plate 103 is connected to the piezoelectric unimorph 101 such that the apex of the vibration plate 103 is in contact with the piezoelectric unimorph 101.

The piezoelectric unimorph 101 is formed by joining a piezoelectric ceramic and a metal plate together, for example. When the positive and negative drive voltages are alternately applied to the piezoelectric unimorph 101, the piezoelectric ceramic radially contracts and extends while the metal plate does not change, thereby achieving a bending displacement like a bimetal. Thus, the entire piezoelectric unimorph 101 alternately deforms into a convex shape and a concave shape to achieve the vibration-like motion.

Figure 24:
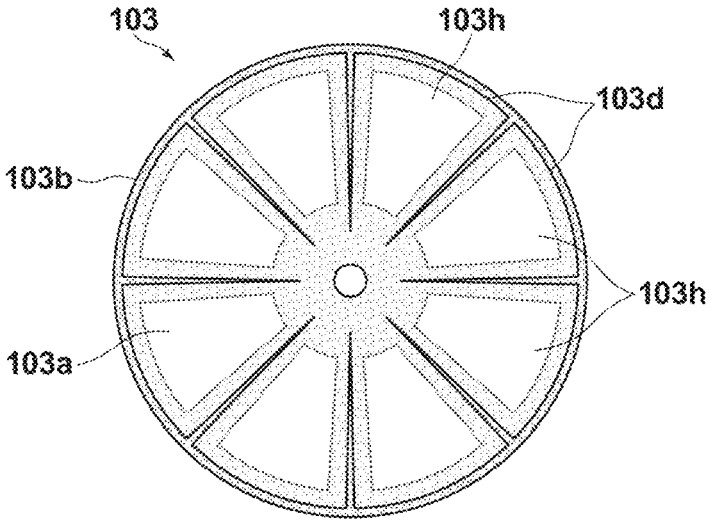
FIG. 24 is a plan view of a vibration plate of the ultrasound emitter element.

FIG. 24 is a plan view of the vibration plate 103. As shown in FIG. 24, the vibration plate 103 includes a parabola-shaped frame 103*b* (the area shown in gray) and a petal-shaped film 103*a* that is attached on the inner side of the frame 103*b*.

Figure 25A:
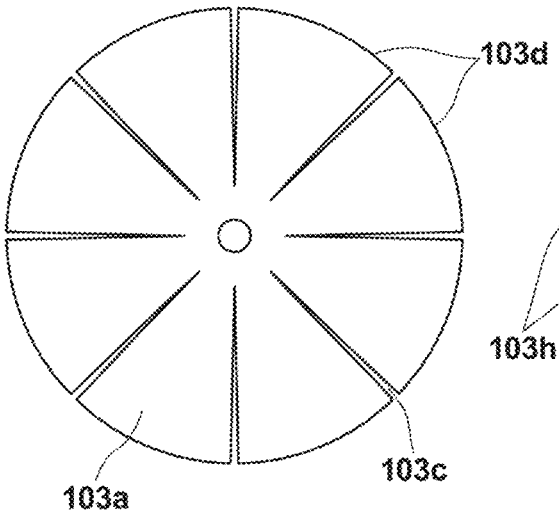
FIG. 25A is a diagram showing one example of a petal-shaped film forming the vibration plate.

The petal-shaped film 103*a* is made of a soft elastic member, such as a polyethylene terephthalate film, a polypropylene film, or a styrol film. As shown in FIG. 25A, the petal-shaped film 103*a* is formed by forming a plurality of radially extending slits 103*c* in a circular film. This film is called the "petal-shaped film" since each film portion 103*d* separated by the slits 103*c* has a shape like a petal.

Figure 25B:
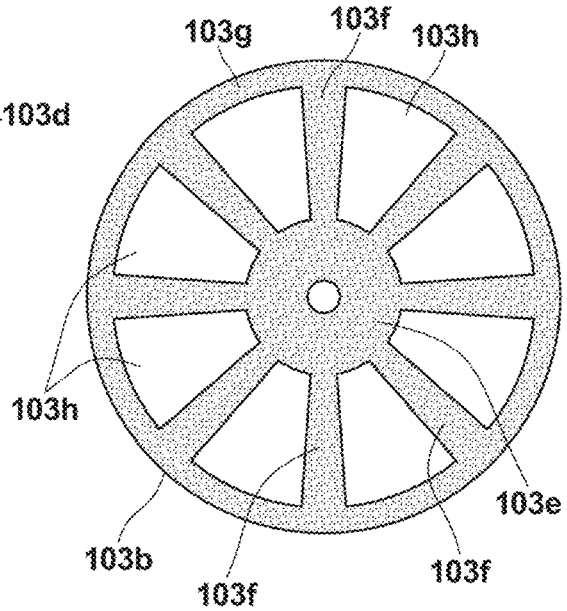
FIG. 25B is a diagram showing one example of a frame forming the vibration plate.

As shown in FIG. 25B, the frame 103*b* is formed by forming a plurality of fan-shaped holes 103*h* in a parabola-shaped plate having a certain level of rigidity, and has a framed structure including a central area 103*e*, linear portions 103*f* radially extending from the central area, and a peripheral area 103*g*. The width of each linear portion 103*f* is greater than the width of each slit 103*c* of the petal-shaped film 103*a*.

As shown in FIG. 24, each petal-shaped film portion 103*d* is positioned correspondingly to each hole 103*h* of the frame 103*b*, and only the central area of the petal-shaped film 103*a* is bonded to the central area 103*e* of the frame 103*b*. Thus, each petal-shaped film portion 103*d*, other than the central area, is adapted to be able to be in contact with or separated from the frame 103*b*.

Then, when the positive (or negative) drive voltage is applied to the drive voltage application terminals 102 of the ultrasound emitter element 100 of this embodiment, the piezoelectric unimorph 101 deforms into a convex shape, as shown in FIG. 23, and thus the vibration plate 103 is moved upward (in the direction of the arrow shown in FIG. 23, toward the opening of the parabola shape). At this time, the petal-shaped film 103*a* is pressed against the frame 103*b* due to air resistance and the petal-shaped film 103*a* is in close contact with the frame 103*b*.

Figure 26:
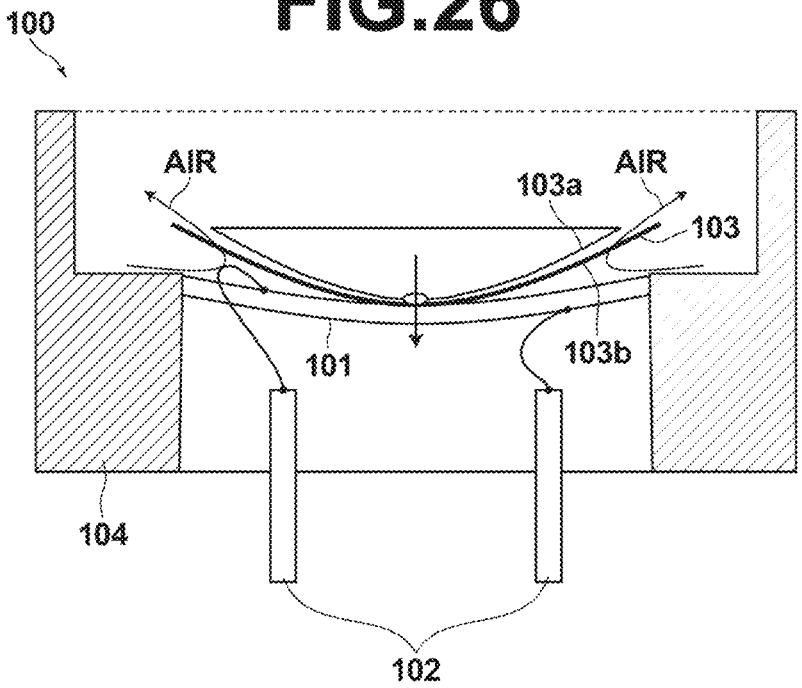
FIG. 26 is a diagram for explaining operation when the vibration plate is moved downward (toward the apex of a parabola shape)
Figure 27:
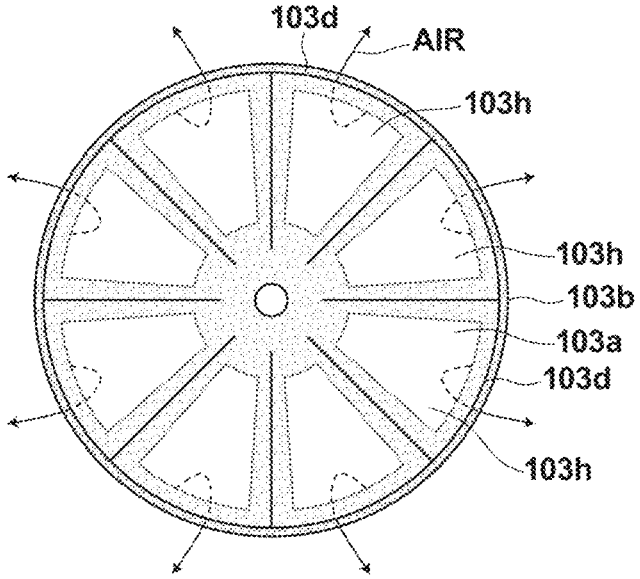
FIG. 27 is a diagram for explaining operation when the vibration plate is moved downward (toward the apex of a parabola shape)

On the other hand, when the negative (or positive) drive voltage is applied to the drive voltage application terminals 102, the piezoelectric unimorph 101 deforms into a concave shape, as shown in FIG. 26, and thus the vibration plate 103 is moved downward (in the direction of the arrow shown in FIG. 26 toward the apex of the parabola shape). At this time, as shown in FIGS. 26 and 27, air flows in through the holes 103*h* of the frame 103*b* toward the petal-shaped film 103*a* side and each petal-shaped film portion 103*d* is separated from the frame 103*b* due to the wind pressure.

That is, the ultrasound emitter element 100 of this embodiment is configured such that the vibration plate 103 moves upward and downward when the positive and negative drive voltages are alternately supplied, and the petal-shaped film 103*a* is in close contact with the frame 103*b* while the vibration plate 103 moves upward, and the petal-shaped film 103*a* is separated from the frame 103*b* while the vibration plate 103 moves downward.

Next, ultrasound emitted from the ultrasound emitter element 100 of this embodiment when the vibration plate 103 moves upward and downward, as described above, is described in comparison with ultrasound emitted from a conventional ultrasound emitter element.

Figure 28:
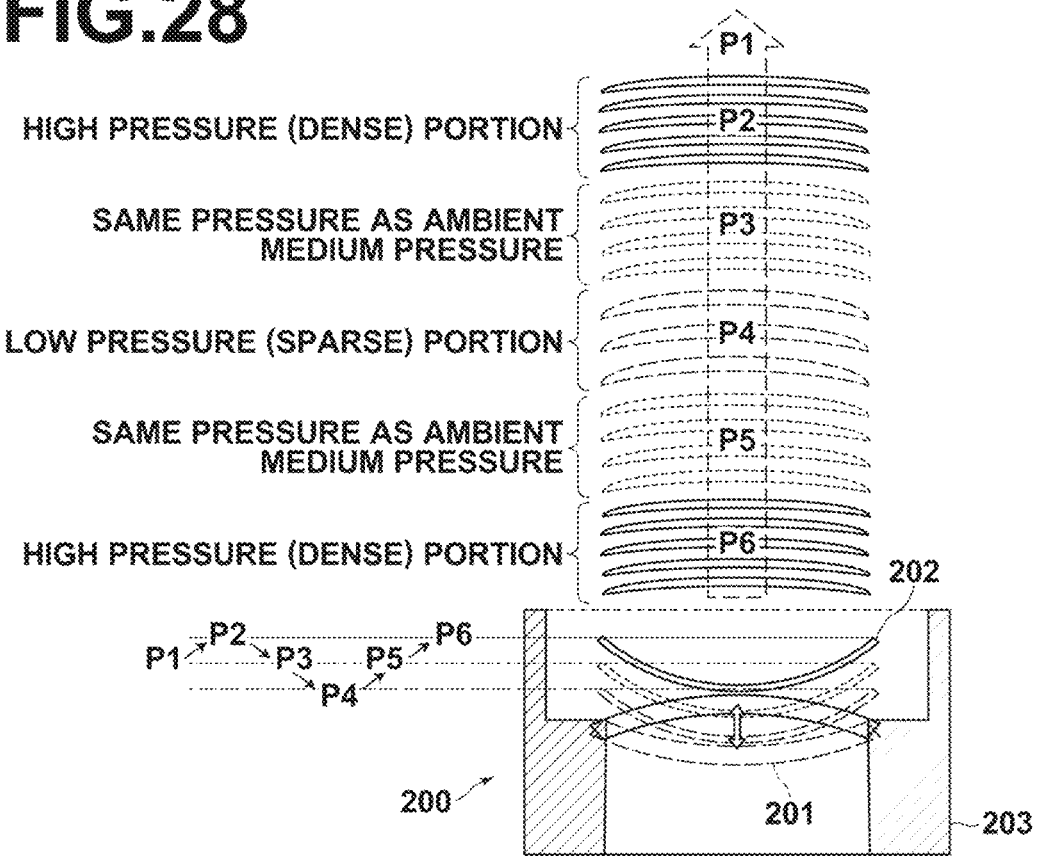
FIG. 28 is a diagram for explaining ultrasound emitted from a conventional ultrasound emitter element.

First, ultrasound emitted from a conventional ultrasound emitter element 200 is described. It should be noted that the difference between the conventional ultrasound emitter element 200 and the ultrasound emitter element 100 of the above-described embodiment lies only in the structure of the vibration plate. As shown in FIG. 28, the conventional ultrasound emitter element 200 includes: a piezoelectric unimorph 201; a housing 203 in which the piezoelectric unimorph 201 is secured; and a parabola-shaped vibration plate 202 disposed on the piezoelectric unimorph 201. The vibration plate 202 of the conventional ultrasound emitter element 200 is formed by one simple parabola-shaped plate, unlike the vibration plate 103 of the ultrasound emitter element 100 of the above-described embodiment wherein air passes through the vibration plate 103 while the vibration plate 103 moves downward.

In the conventional ultrasound emitter element 200, when positive and negative drive voltages are alternately supplied to the piezoelectric unimorph 201, the piezoelectric unimorph 201 alternately deforms into a convex shape and a concave shape, and thus the vibration plate 202 is sequentially moved to positions corresponding to P1 to P6 shown in FIG. 28.

As the vibration plate 202 is moved, ultrasound is emitted. The ultrasound emitted when the vibration plate 202 is moved to the positions corresponding to P1 to P6 has a balanced distribution of dense wave portions and sparse wave portions, forming a pressure wave like AC, where non-linear characteristics of a transmission medium (air in this example) that transmits the emitted ultrasound is not taken into account.

Specifically, as shown in FIG. 28, when the vibration plate 202 is moved to the position corresponding to P2 and P6, i.e., the uppermost position, a high pressure portion is formed. When the vibration plate 202 is moved to the position corresponding to P4, i.e., the lowermost position, a low pressure portion is formed. When the vibration plate 202 is moved to the position corresponding to P3 and P5, a portion having the same pressure as the ambient medium pressure is formed.

Figure 29:
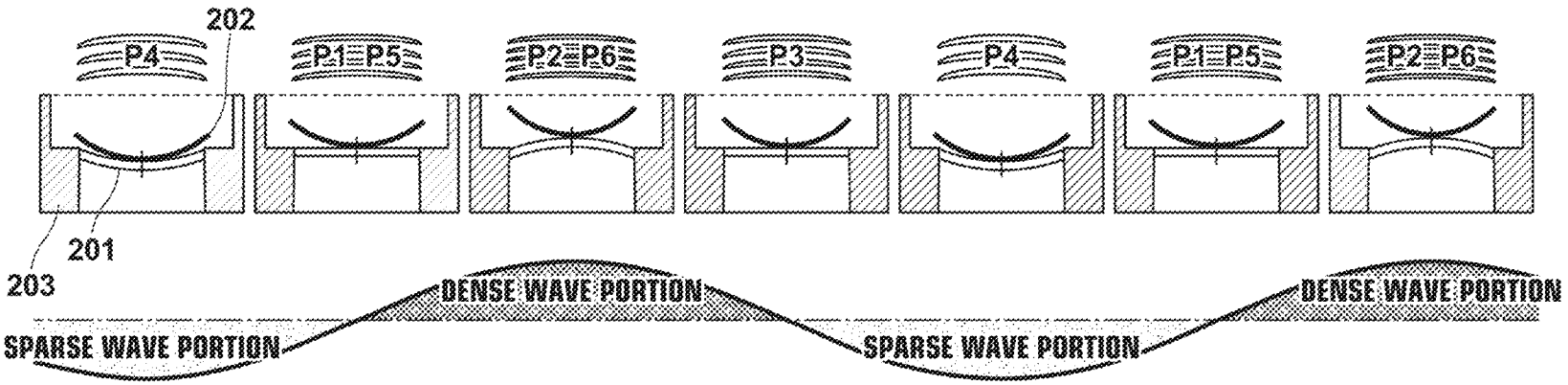
FIG. 29 is a diagram showing a waveform of sound pressure of ultrasound when the vibration plate shown in FIG. 28 is moved to positions corresponding to P1 to P6.

FIG. 29 shows a waveform of the sound pressure of the ultrasound when the vibration plate 202 is moved to the positions corresponding to P1 to P6. As shown in FIG. 29, ultrasound emitted from the conventional ultrasound emitter element 200 forms an AC wave where sparse wave portions and dense wave portions symmetrically appear, i.e., linear ultrasound where a pressure in the positive direction that is generated when the vibration plate 202 is moved upward and a pressure in the negative direction that is generated when the vibration plate 202 is moved downward are the same.

Next, ultrasound emitted from the ultrasound emitter element 100 of this embodiment is described.

Figure 30:
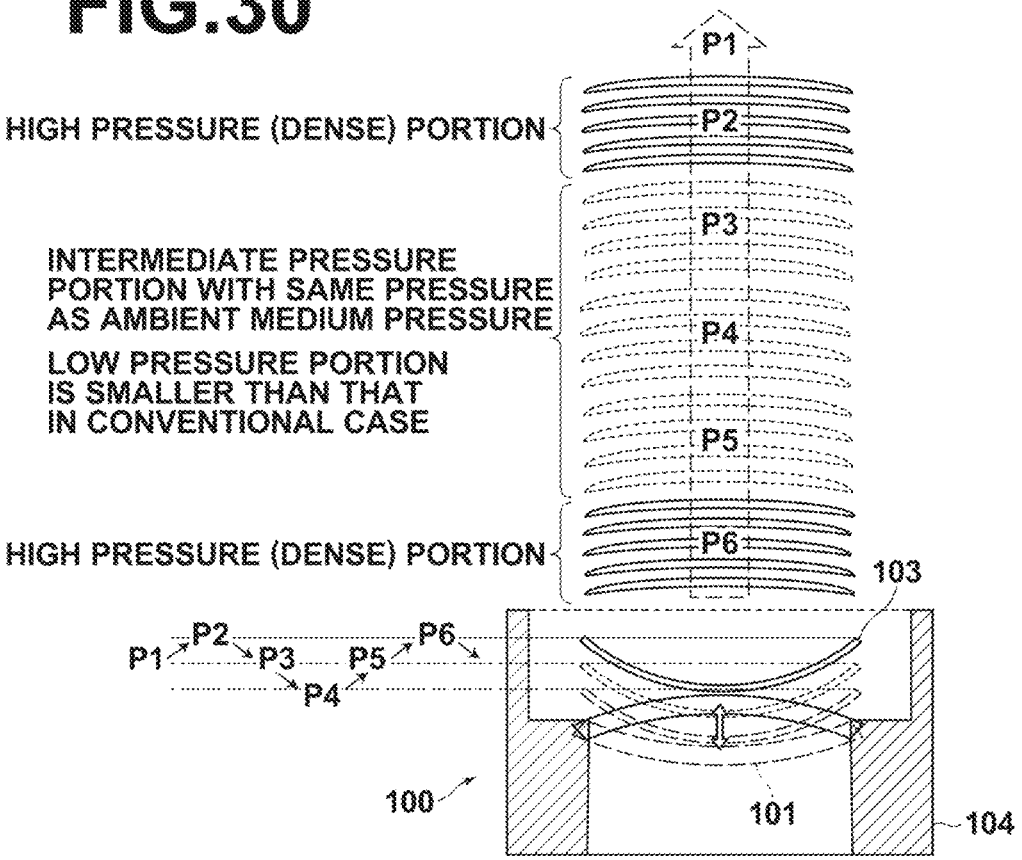
FIG. 30 is a diagram for explaining ultrasound emitted from the ultrasound emitter element of one embodiment of the invention.

As described above, the piezoelectric unimorph 101 of the ultrasound emitter element 100 of this embodiment also alternately deforms into a convex shape and a concave shape when positive and negative drive voltages are alternately supplied to the piezoelectric unimorph 101, and thus the vibration plate 103 is sequentially moved to positions corresponding to P1 to P6 shown in FIG. 30.

As the vibration plate 103 is moved, ultrasound is emitted. In the case of the ultrasound emitter element 100 of this embodiment, air passes through the holes 103*h* of the vibration plate 103 while the vibration plate 103 is moved downward, as described above.

Therefore, the ultrasound emitted from the vibration plate 103 when the vibration plate 103 is moved to the positions corresponding to P1 to P6 shown in FIG. 30 is such that a high pressure portion is formed when the vibration plate 202 is moved to the position corresponding to P2 and P6, i.e., the uppermost position, and a low pressure portion is formed when the vibration plate 103 is moved to the position corresponding to P4, i.e., the lowermost position, where the low pressure portion is smaller than the low pressure portion formed in the case of the conventional ultrasound emitter element 200. The ultrasound emitted from the ultrasound emitter element 100 has a pressure wave similar to that of a valved piston pump, and generates pressure that is high in one direction, in cooperation with the non-linear characteristics of the transmission medium that transmits the emitted ultrasound.

Figure 31:
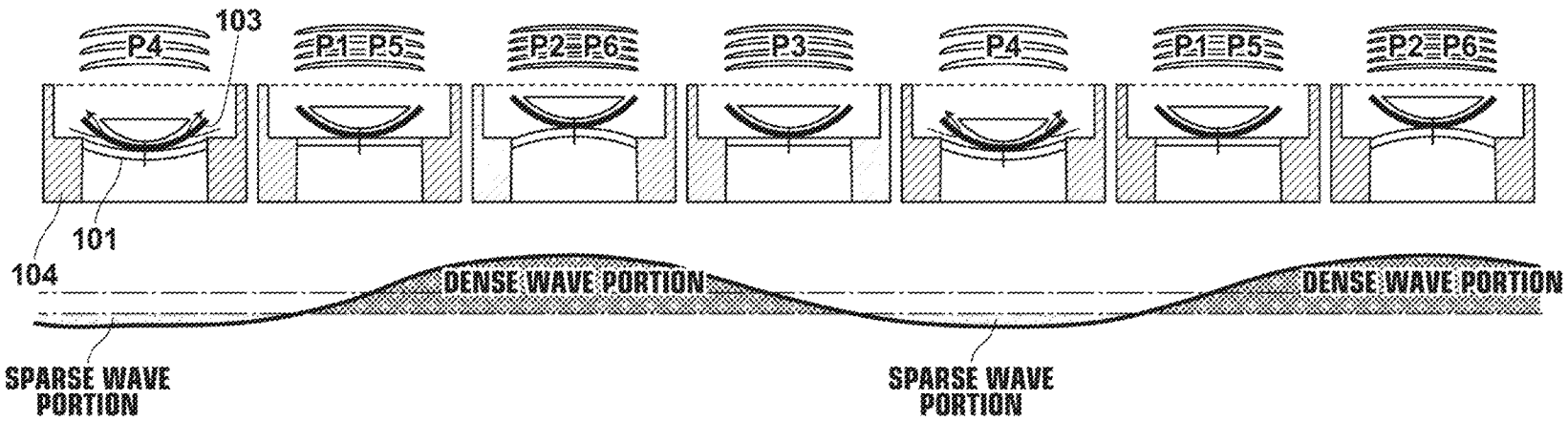
FIG. 31 is a diagram showing a waveform of sound pressure of ultrasound when the vibration plate shown in FIG. 30 is moved to positions corresponding to P1 to P6.

FIG. 31 shows a waveform of the sound pressure of the ultrasound when the vibration plate 103 is moved to the positions corresponding to P1 to P6. As shown in FIG. 31, in the case of the ultrasound emitter element 100 of this embodiment, the petal-shaped film 103*a* of the vibration plate 103 serves as a valve and allows providing non-linear ultrasound where the pressure of the sparse wave portion is higher than that of the ultrasound emitted from the conventional ultrasound emitter element 200, i.e., ultrasound where pressures of the dense wave portions and the sparse wave portions of the compressional wave are asymmetric. That is, non-linear ultrasound where the pressure in the negative direction that is generated when the vibration plate 103 is moved downward is smaller than the pressure in the positive direction that is generated when the vibration plate 103 is moved upward, i.e., non-linear ultrasound where a pressure offset amount is added and the pressure is high in one direction, as shown in FIG. 31, can be emitted.

Although the vibration plate 103 of the ultrasound emitter element 100 of the above-described embodiment includes the petal-shaped film 103*a* and the frame 103*b*, where each film portion 103*d* of the petal-shaped film 103*a* operates as a valve, the vibration plate 103 may have a different structure.

Figure 32:
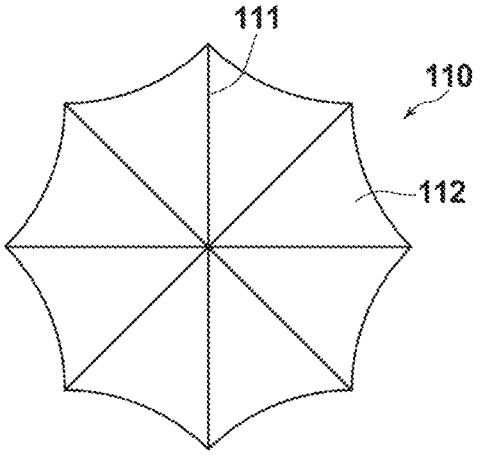
FIG. 32 is a plan view showing another embodiment of the vibration plate of the ultrasound emitter element of the invention.

Specifically, as shown in FIG. 32, for example, a parabola-shaped vibration plate 110 may be formed by forming and radially disposing about six to eight parabolic ribs 111 that support a thin resin film 112 made of a vinyl resin having a thickness of about 0.05 mm to 0.1 mm. The ribs 111 may be made of an elastic material, such as thin piano wires.

The vibration plate 110 shown in FIG. 32 is connected to the piezoelectric unimorph 101 at the center thereof in a state like an upside-down umbrella. Then, when the piezoelectric unimorph 101 deforms into a convex shape and the vibration plate 110 is moved upward, as shown at I in FIG. 33, the vibration plate 110 moves in the state like an open umbrella with little deformation.

Figure 33:
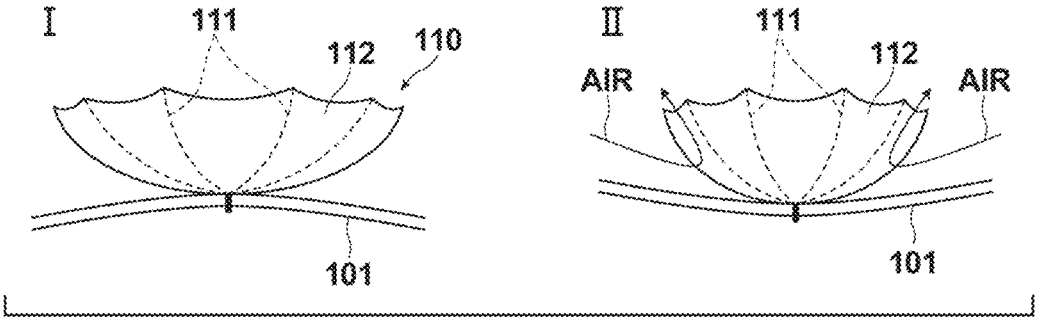
FIG. 33 is a diagram for explaining operation of the vibration plate shown in FIG. 32.

On the other hand, as shown at II in FIG. 33, when the piezoelectric unimorph 101 deforms into a concave shape and the vibration plate 110 is moved downward, the ribs 111 deforms inward due to air resistance against the resin film 112 of the vibration plate 110, letting the air pass through upward (in the directions of the arrows) along the outer side of the resin film 112. This structure also allows reducing the low pressure portions when compared to the case of the conventional ultrasound emitter element 200, thereby allowing emission of ultrasound that generates pressure that is high in one direction.

Figure 34:
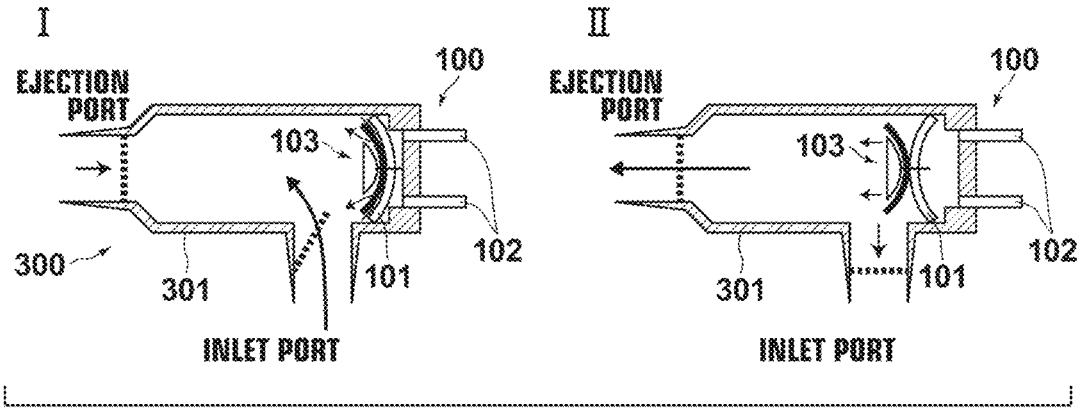
FIG. 34 is a cross-sectional view illustrating the structure of an ultrasonic small pump employing one embodiment of the ultrasound emitter element of the invention.

Use of the ultrasound emitter element 100 of the above-described embodiment is not limited to pressing the printing paper sheet P as described above, and the ultrasound emitter element 100 may be used in other applications. Specifically, the ultrasound emitter element 100 may be used in an ultrasonic small pump, for example. FIG. 34 (I and II) is a diagram illustrating an ultrasonic small pump 300 that employs the ultrasound emitter element 100. The ultrasonic small pump 300 includes: a pump cylinder 301 that once stores a fluid, such as ink, introduced through an inlet port; and the ultrasound emitter element 100 disposed inside the pump cylinder 301.

In the ultrasonic small pump 300, a drive voltage is applied to the drive voltage application terminals 102 to deform the piezoelectric unimorph 101 into a concave shape, as shown at I in FIG. 34, to thereby move the vibration plate 103. This movement of the vibration plate 103 forms a low pressure area in the pump cylinder 301, thereby allowing introducing a fluid, such as ink, through the inlet port of the pump cylinder 301.

On the other hand, as shown at II in FIG. 34, a drive voltage is applied to the drive voltage application terminals 102 to deform the piezoelectric unimorph 101 into a convex shape to thereby move the vibration plate 103. This movement of the vibration plate 103 applies pressure to the fluid stored in the pump cylinder 301, thereby allowing ejecting the fluid, such as ink, through the ejection port of the pump cylinder 301.

According to the ultrasonic small pump 300 employing the ultrasound emitter element 100, using the ultrasound emitter element 100 having the non-linear characteristics eliminates necessity of providing a conventional valve structure, as indicated by the dashed lines shown at I and II in FIG. 34, thereby allowing a simple structure of the pump with less likelihood of failure. In a case where the ultrasonic small pump 300 is used as an intermediate ink channel pump in the ink head unit 10, a space-saving shortest ink path can be provided.

It is desirable that the drive voltage application terminals 102 of the piezoelectric unimorph 101 of the ultrasound emitter element 100, 110 be coated with polyimide or polyurethane to prevent corrosion by a liquid and to provide insulation.

What is claimed is:

1. A conveyance device comprising:

a conveyance unit that conveys a medium to be conveyed in a given conveyance direction; and a pressing unit that presses the medium to be conveyed with ultrasound emitted from a plurality of ultrasound emitter elements, the ultrasound emitter elements being arranged in a direction perpendicular to the conveyance direction and emitting ultrasound of an identical frequency and an identical phase.

2. The conveyance device as claimed in claim 1, wherein the conveyance unit is disposed to face the pressing unit such that the medium to be conveyed is conveyed between the conveyance unit and the pressing unit.

3. The conveyance device as claimed in claim 1, wherein the pressing unit comprises a plurality of pressing units arranged along the conveyance direction, and the pressing units emit the ultrasound in turn from the most upstream-side pressing unit to the most downstream-side pressing unit in the conveyance direction.

4. The conveyance device as claimed in claim 3, wherein the conveyance unit comprises a conveying roller, and a plurality of sets of the pressing unit and the conveying roller are disposed along the conveyance direction.

5. The conveyance device as claimed in claim 3, further comprising a conveyance position detection unit that detects a conveyance position of the medium to be conveyed, wherein each pressing unit starts emission of the ultrasound at or after a point of time when the leading edge of the medium to be conveyed reaching the pressing unit is detected by the conveyance position detection unit.

6. The conveyance device as claimed in claim 5, wherein each pressing unit stops emission of the ultrasound at a point of time when the trailing edge of the medium to be conveyed being just about to pass through the pressing unit is detected by the conveyance position detection unit.

7. The conveyance device as claimed in claim 3, further comprising a conveyance position detection unit that detects a conveyance position of the medium to be conveyed, wherein each pressing unit starts emission of the ultrasound at a point of time when the leading edge of the medium to be conveyed reaching a position just in front of the pressing unit is detected by the conveyance position detection unit.

8. The conveyance device as claimed in claim 1, further comprising a driving unit that supplies a drive voltage having a drive frequency corresponding to the frequency and the phase of the ultrasound to each of the ultrasound emitter elements, wherein the driving unit changes the drive voltage depending on information about the medium to be conveyed.

9. The conveyance device as claimed in claim 1, wherein the pressing unit emits the ultrasound from the ultrasound emitter elements in order from the ultrasound emitter element disposed at the center in the direction perpendicular to the conveyance direction to the ultrasound emitter elements disposed at opposite ends in the direction perpendicular to the conveyance direction.

10. The conveyance device as claimed in claim 1, wherein the ultrasound emitter element comprises a plate-like deformable plate portion that deforms into a convex shape and a concave shape in response to application of drive voltages, and a vibration plate comprising a parabola shape, the vibration plate being connected such that the apex of the parabola shape is in contact with the deformable plate portion, wherein the vibration plate has a structure that deforms toward the inner side of the parabola shape when the deformable plate portion deforms into the concave shape to move toward the apex of the parabola shape, and the vibration plate emits non-linear ultrasound wherein a pressure in a negative direction that is generated when the vibration plate moves toward the apex of the parabola shape is smaller than a pressure in a positive direction that is generated when the vibration plate moves toward the opening of the parabola shape.

11. The conveyance device as claimed in claim 10, wherein the vibration plate comprises a frame including a plurality of radially extending linear portions, and a petal-shaped film provided on the inner side of the parabola shape of the frame, the petal-shaped film including slits formed at positions corresponding to the linear portions, wherein, when the vibration plate moves toward the apex, peripheral areas of the petal-shaped film are separated from the frame to let air flow in.

12. The conveyance device as claimed in claim 10, wherein the vibration plate comprises a plurality of elastic ribs radially arranged against a resin film, wherein, when the vibration plate moves toward the apex of the parabola shape, the ribs deform toward the inner side of the parabola shape.

13. The conveyance device as defined in claim 1, wherein: the pressing unit emits ultrasound in the ink ejecting direction of an ink ejecting unit that ejects ink onto the medium to be conveyed.

14. The conveyance device as defined in claim 1, wherein: the pressing unit presses the medium to be conveyed in a non contact manner by the ultrasound.

15. The conveyance device as claimed in claim 1, further comprising a driving unit that supplies a drive voltage having a drive frequency corresponding to the frequency and the phase of the ultrasound to each of the ultrasound emitter elements.

* * * * *